US011054130B2

(12) United States Patent
Park et al.

(10) Patent No.: US 11,054,130 B2
(45) Date of Patent: Jul. 6, 2021

(54) APPARATUS FOR RAISING THE TEMPERATURE OF SUPERHEATED STEAM AND ULTRA-HIGH TEMPERATURE STEAM GENERATOR

(71) Applicant: KOREA INSTITUTE OF ENERGY RESEARCH, Daejeon (KR)

(72) Inventors: Seong Ryong Park, Daejeon (KR); Chong Pyo Cho, Daejeon (KR); Jeong Geun Kim, Daejeon (KR); Nam Sun Nho, Daejeon (KR)

(73) Assignee: Korea Institute of Energy Research, Daejeon (KR)

( * ) Notice: Subject to any disclaimer, the term of this patent is extended or adjusted under 35 U.S.C. 154(b) by 132 days.

(21) Appl. No.: 16/434,811

(22) Filed: Jun. 7, 2019

(65) Prior Publication Data

US 2019/0376682 A1 Dec. 12, 2019

(30) Foreign Application Priority Data

Jun. 11, 2018 (KR) ..... 10-2018-0066757
Mar. 28, 2019 (KR) ..... 10-2019-0035730
Mar. 28, 2019 (KR) ..... 10-2019-0035750

(51) Int. Cl.
*F22G 5/00* (2006.01)
*F22G 5/16* (2006.01)
(Continued)

(52) U.S. Cl.
CPC ..... *F22G 3/00* (2013.01); *F22B 1/003* (2013.01); *F22G 1/16* (2013.01); *F22G 7/06* (2013.01)

(58) Field of Classification Search
CPC ... F22B 1/003; F22G 1/16; F22G 3/00; F22G 3/006; F22G 5/00; F22G 5/02; F22G 5/12; F22G 5/16
See application file for complete search history.

(56) References Cited

U.S. PATENT DOCUMENTS 2,079,017 A * 5/1937 Iddings ..... B01J 3/04 422/204
3,955,941 A * 5/1976 Houseman ..... F02M 25/12 48/95
(Continued)

FOREIGN PATENT DOCUMENTS

GB 463738 A * 4/1937 ..... F22B 1/003
GB 500337 A * 2/1939 ..... F22G 5/16
(Continued)

*Primary Examiner* — Gregory A Wilson
(74) *Attorney, Agent, or Firm* — Rabin & Berdo, P.C.

(57) ABSTRACT

An apparatus for raising the temperature of superheated steam includes an inlet into which superheated steam is introduced, a body to raise the temperature of the superheated steam heated by an external heat source and introduced through the inlet, and an outlet provided inside the body and discharging the superheated steam temperature-raised by the body to the outside, in which an inner surface of a sidewall of the body is formed with an inner protrusion for heating the superheated steam while spirally rotating the superheated steam. The Apparatus enhances the flow of superheated steam in the process of raising the temperature by further heating superheated steam caused by waste heat generated in a waste combustion apparatus or the like, and at the same time, increases the area of contact of the superheated steam with a heat source to improve the temperature-raising efficiency.

16 Claims, 21 Drawing Sheets

(51) Int. Cl.

| | |
|---|---|
| ***F22G 3/00*** | (2006.01) |
| ***F22B 1/00*** | (2006.01) |
| ***F22G 1/16*** | (2006.01) |
| *F22G 7/06* | (2006.01) |

(56) References Cited

U.S. PATENT DOCUMENTS

| | | | | |
|---|---|---|---|---|
| 6,481,207 | B2 * | 11/2002 | Miura | B01J 8/0257 60/670 |
| 2004/0187796 | A1 * | 9/2004 | Bosch | F28D 7/024 122/33 |
| 2016/0273760 | A1 * | 9/2016 | Kim | F22G 7/08 |

FOREIGN PATENT DOCUMENTS

| | | | | | |
|---|---|---|---|---|---|
| GB | 606208 | A | * | 8/1948 | F24H 1/43 |
| JP | 1997-192026 | A | | 7/1997 | |
| JP | 2001324289 | A | * | 11/2001 | F28D 7/12 |
| JP | 2004-231466 | A | | 8/2004 | |
| JP | 2012141102 | A | * | 7/2012 | |
| KR | 10-1994-0025939 | A | | 12/1994 | |
| KR | 20000071947 | A | * | 12/2000 | |
| KR | 10-0442560 | B1 | | 7/2004 | |
| KR | 1420346 | | * | 7/2014 | |
| KR | 10-2015-0138550 | A | | 12/2015 | |

* cited by examiner

APPARATUS FOR RAISING THE TEMPERATURE OF SUPERHEATED STEAM AND ULTRA-HIGH TEMPERATURE STEAM GENERATOR

CROSS-REFERENCE TO RELATED APPLICATION

This application claims the benefit of Korean Patent Application No. 10-2018-0066757, filed on Jun. 11, 2018, 10-2019-0035730, filed on Mar. 28, 2019, and 10-2019-0035750 filed on Mar. 28, 2019 filed in the Korean Intellectual Property Office, the entire contents of which are incorporated herein by reference.

TECHNICAL FIELD

The present disclosure relates to an apparatus for raising the temperature of superheated steam. More specifically, the present disclosure relates to an apparatus for raising the temperature by heating further superheated steam due to waste heat generated in a waste combustion apparatus or the like. the present disclosure relates to an apparatus for raising the temperature of superheated steam capable of economically and efficiently providing high temperature superheated steam to an apparatus requiring a high temperature such as a hydrogen generator. Further, the present disclosure relates to an ultra-high temperature steam generator equipped with a coil type superheater for smoothly producing ultra-high temperature steam through heat transfer with high temperature combustion gas.

BACKGROUND

Alternative energy is a way to solve problems such as global warming caused by the use of fossil fuels or environmental pollution problems, and its use and related research and development are increasing.

In particular, since the reserves of fossil energy are limited, the problems of environmental pollution and destruction of the ecosystem during the mining process are very serious.

Among these alternative energies, hydrogen is water and a non-toxic by-product from water.

Hydrogen exists abundantly and in an almost infinite amount in nature. Therefore, researches for the production of hydrogen for energy are actively being carried out, and at the same time, many apparatuses for producing hydrogen are also being developed.

Hydrogen is widely used in the chemical industry such as petroleum desulfurization and ammonia production, and is also used as fuel for the aerospace industry, atmospheric gas for the semiconductor industry, and raw materials for fuel cells. Fossil fuels currently being used as primary energy sources are problematic due to the rising prices and depletion, discharge of air pollutants such as NOx, SOx, and various dusts generated after using, and stricter environmental regulations due to global warming caused by carbon dioxide or the like. As an alternative to these problems, studies on the production and production technology of hydrogen as an environmentally friendly energy source have been actively conducted.

Such hydrogen is produced by steam reforming or partial oxidation using oil or natural gas. Hydrogen produced by these methods has the disadvantage that it may not be used in renewable energy systems. A method of electrolyzing water using an electrochemical cell is used as a permanent renewable energy system, but water decomposition at low temperature requires a lot of energy.

On the other hand, high temperature water vapor provides energy efficiency in comparison to the direct electrolysis of liquid water. The importance of hydrogen production at a high temperature is increasing as it has the advantage of replacing about ⅓ of the energy required for water decomposition with thermal energy and lowering the manufacturing cost by using rapid electrode reaction.

Among them, a solid oxide water electrolytic cell may generate hydrogen gas by electrolyzing water vapor at 600° C. to 800° C. Such a solid oxide electrolytic cell solves the problem of electricity consumption because it consumes less energy than electrolysis using high temperature heat of 800° C. or higher, but the supply of high temperature energy is still a problem.

Korean Patent Publication No. 10-0442560 discloses a heating element, in which it includes calcium oxide, aluminum chloride anhydride and caustic soda, aluminum metal powder and calcium chloride aqueous solution, and it uses the reaction heat generated in hydration and neutralization reactions. However, this heating element has a problem that a large amount of impurities other than hydrogen may be generated, and thus, there is a limit to use as a composition for generating hydrogen or a hydrogen generator.

Further, Korean Patent Laid-Open Publication No. 10-1994-0025939 discloses a method for producing a hydrogen generator using aluminum powder or calcium oxide. However, there is a problem that it may not efficiently generate a sufficient amount of hydrogen to be practically used.

Also, Japanese Patent Laid-Open No. 2004-231466 discloses a hydrogen generating material which reacts with water, including aluminum powder, calcium oxide powder, and further water-retaining agent. However, it is problematic in terms of the rate and efficiency of hydrogen generation.

Further, Japanese Patent Laid-Open No. 1997-192026 discloses a heating element which is housed in a water-permeable envelope in which about 1% by weight of aluminum oxide is added to a mixture of 85 to 90% by weight of quicklime and 15 to 10% by weight of anhydrous magnesium. However, here, the amount of quicklime combined with anhydrous magnesium chloride is 100% by weight, and it contains only 1% by weight of aluminum oxide. Therefore, it is also insufficient in terms of the rate and efficiency of hydrogen generation.

In order to solve the above problems, Korean Patent Laid-Open No. 10-2015-0138550 (hereinafter, '550 patent), which has been already filed by the present applicant, discloses a high temperature heating apparatus comprising an inflow path through which waste heat generated in a waste combustion apparatus is introduced; a body on which the inflow path is attached to a side of it so as to communicate with it, the body heating the waste heat introducing through the inflow path with high heat by an external heat source; and a discharge path communicating with the inside of the body and discharging the heat source heated by the high heat to the outside.

However, the '550 patent has a limit in that the time for staying in the body of the waste heat introduced into the temperature raising apparatus through the decompressor is not so long, so that the effect of temperature rise due to heat exchange is not so high.

RELATED ART DOCUMENT

Patent Document

Korean Patent No. 10-0442560
Korean Patent Laid-Open No. 10-1994-0025939

Japanese Patent Laid-Open No. 2004-231466
Japanese Patent Laid-Open No. 1997-192026
Korean Patent Laid-Open No. 10-2015-0138550

SUMMARY

The object of the present disclosure is to provide an apparatus for raising the temperature of superheated steam capable of enhancing the flow of superheated steam in the process of raising the temperature by further heating superheated steam caused by waste heat generated in a waste combustion apparatus or the like, and at the same time, increasing the area of contact of the superheated steam with a heat source to improve the temperature-raising efficiency.

The other object of the present disclosure is to provide an economically superior apparatus for raising the temperature of superheated steam, in which the apparatus uses waste heat of a waste combustion apparatus or the like to raise the temperature of a heat source transferred to an apparatus requiring a high temperature such as a hydrogen generator with high heat and to transfer it to the hydrogen generator, thereby allowing high heat necessary for hydrogen generation to be constantly supplied to the hydrogen generator so as to produce high quality hydrogen smoothly and allowing one to obtain high heat easily using the waste heat.

Another object of the present disclosure is to provide an ultra-high temperature steam generator equipped with a coil type superheater for smoothly producing ultra-high temperature steam through heat transfer with high temperature combustion gas.

An apparatus for raising the temperature of superheated steam according to the present disclosure for the above purposes includes an inlet into which superheated steam is introduced, a body to raise the temperature of the superheated steam heated by an external heat source and introduced through the inlet, and an outlet provided inside the body and discharging the superheated steam temperature-raised by the body to the outside, in which an inner surface of a sidewall of the body is formed with an inner protrusion for heating the superheated steam while spirally rotating the superheated steam.

In an apparatus for raising the temperature of superheated steam according to the present disclosure, the inner protrusion protrudes from the inner surface of the sidewall of the body and has a spiral projection shape extending obliquely toward an inner surface of a bottom of the body, a lower end of the outlet has an opening shape that is opened toward the inner surface of the bottom of the body in a state of being separated from the inner surface of the bottom of the body.

In the apparatus for raising the temperature of superheated steam according to the present disclosure, the superheated steam introduced through the inlet is induced as a first swirl while being spirally rotated by the inner protrusion, thereby primarily allowing a flow of the superheated steam to be enhanced, and at the same time, allowing the heating efficiency to be increased by increasing a contact area with the inner protrusion heated by the external heat source.

In the apparatus for raising the temperature of superheated steam according to the present disclosure, the superheated steam guided to the inner surface of the bottom of the body by the inner protrusion is introduced into the lower end of the outlet having the opening shape that is opened toward the inner surface of the bottom of the body and is discharged to the outside, thereby increasing the heat discharge efficiency.

In the apparatus for raising the temperature of superheated steam according to the present disclosure, a protruding height of the inner protrusion is larger than a diameter of the inlet.

In the apparatus for raising the temperature of superheated steam according to the present disclosure, an end of the inner protrusion has a shape bent upward in parallel with the inner surface of the sidewall of the body.

In the apparatus for raising the temperature of superheated steam according to the present disclosure, the superheated steam introduced through the inlet and induced as the first swirl by the inner protrusion is induced as a second swirl by the end of the inner protrusion, thereby secondarily allowing a flow of the superheated steam to be enhanced, and at the same time, allowing the heating efficiency to be increased by increasing a contact area with the inner protrusion heated by the external heat source.

In the apparatus for raising the temperature of superheated steam according to the present disclosure, an outer surface of the sidewall of the body is formed with an outer protrusion for increasing the heating efficiency by increasing an area exposed to the external heat source.

In the apparatus for raising the temperature of superheated steam according to the present disclosure, the outer protrusion protrudes from the outer surface of the sidewall of the body and has a shape inclined downward of the body.

In the apparatus for raising the temperature of superheated steam according to the present disclosure, a bottom protrusion is formed on the inner surface of the bottom of the body to rise the superheated steam so as to guide the superheated steam to the outlet.

In the apparatus for raising the temperature of superheated steam according to the present disclosure, the inner surface of the bottom of the body has a cone shape inverted with respect to the lower end of the outlet.

In the apparatus for raising the temperature of superheated steam according to the present disclosure, the superheated steam is concentrated in a vertex region of the inner surface of the bottom of the body having a cone shape, and then rises and is introduced into the outlet to discharge to the outside, thereby increasing the heat discharge efficiency.

In the apparatus for raising the temperature of superheated steam according to the present disclosure, the outlet is connected to a hydrogen generator for electrolyzing water using an electrochemical cell, and the superheated steam temperature-raised is supplied to the hydrogen generator.

In the apparatus for raising the temperature of superheated steam according to the present disclosure, the body has a cylindrical structure whose cross-section perpendicular to a gravity direction is circular, and the inner protrusion protrudes in a direction perpendicular to a tangent of the cylindrical structure.

In the apparatus for raising the temperature of superheated steam according to the present disclosure, a connecting portion between the inner protrusion and the inner wall of the sidewall has a contact surface with the superheated steam, with the contact surface having a concave shape.

A further apparatus for raising the temperature of superheated steam according to the present disclosure includes an inlet into which superheated steam is introduced, a body to raise the temperature of the superheated steam heated by an external heat source and introduced through the inlet, and an outlet provided inside the body and discharging the superheated steam temperature-raised by the body to the outside, in which an inner surface of the sidewall of the body is formed with an inner protrusion for heating the superheated steam while rotating the superheated steam along the inner surface of the sidewall, and an end of the inner protrusion has a shape bent upward in parallel with the inner surface of the sidewall of the body.

In the further apparatus for raising the temperature of superheated steam according to the present disclosure, the superheated steam introduced through the inlet and induced as a first swirl by the inner protrusion is induced as a second swirl by the end of the inner protrusion, thereby secondarily allowing a flow of the superheated steam to be enhanced, and at the same time, allowing the heating efficiency to be increased by increasing a contact area with the inner protrusion heated by the external heat source.

Another apparatus for raising the temperature of superheated steam according to the present disclosure includes an inlet into which superheated steam is introduced, a body to raise the temperature of the superheated steam heated by an external heat source and introduced through the inlet, and an outlet provided inside the body and discharging the superheated steam temperature-raised by the body to the outside, in which an inner surface of the sidewall of the body is formed with an inner protrusion for heating the superheated steam while rotating the superheated steam along the inner surface of the sidewall, and an outer surface of the sidewall of the body is formed with an outer protrusion to increase an area exposed to the external heat source to increase the thermal efficiency.

In another apparatus for raising the temperature of superheated steam according to the present disclosure, the outer protrusion protrudes from the outer surface of the sidewall of the body and has a shape inclined downward of the body.

A further apparatus for raising the temperature of superheated steam according to the present disclosure includes an inlet into which superheated steam is introduced, a body to raise the temperature of the superheated steam heated by an external heat source and introduced through the inlet, an outlet provided inside the body and discharging the superheated steam temperature-raised by the body to the outside, and a steam pipe forming a flow path through which the superheated steam flows and connected to the inlet, in which the steam pipe is formed on an outer surface of the body.

In the further apparatus for raising the temperature of superheated steam according to the present disclosure, the steam pipe is formed in a coil shape so as to surround the outer surface of the body.

In the further apparatus for raising the temperature of superheated steam according to the present disclosure, the steam pipe surrounds the body in a horizontal or vertical direction with respect to an outer peripheral surface of the body.

In the further apparatus for raising the temperature of superheated steam according to the present disclosure, the steam pipe includes a first steam pipe which forms a spiral flow path in an up and down vertical direction with respect to the outer peripheral surface of the body and surrounds the outer peripheral surface of the body.

In the further apparatus for raising the temperature of superheated steam according to the present disclosure, the steam pipe includes a second steam pipe which forms a flow path through which the superheated steam flows in a meandering shape along a horizontal direction with respect to an outer circumferential surface of the body and surrounds an outer circumferential surface of the body.

In the further apparatus for raising the temperature of superheated steam according to the present disclosure, the second steam pipe includes an upward pipe through which the superheated steam flows from a lower toward an upper with respect to the outer peripheral surface of the body, a downward pipe through which the superheated steam flows from the upper toward the lower with respect to the outer peripheral surface of the body, and a connecting pipe to interconnect an upper end of the upward pipe and an upper end of the downward pipe or to interconnect a lower end of the upward pipe and a lower end of the downward pipe, in which the second steam pipe is formed by repeatedly disposing the upward pipe and the connecting pipe, and the downward pipe and the connecting pipe with respect to the outer peripheral surface of the body.

Another ultra-high temperature steam generator equipped with a coil type superheater according to the present disclosure includes a superheater including an inlet port connected to an exit side of a boiler for introducing steam discharged from an exit of the boiler, an outlet port for discharge steam introduced through the inlet port, a temperature-raising pipe for interconnecting the inlet port and the outlet port and forming a coil-shaped flow path for raising the temperature of the steam introduced through the inlet port; and a furnace having a space into which the superheater is built, the furnace including a gas inlet port into which combustion gas is introduced, and a gas outlet port through which the combustion gas is discharged, the combustion gas introducing from the gas inlet port and transferring convection heat to the superheater.

The superheater according to the present disclosure further includes a cylindrical first inner wall having an outer circumferential surface of a first diameter facing an inner circumferential surface of the temperature-raising pipe forming the coil-shaped flow path.

Another superheater according to the present disclosure further includes a cylindrical first inner wall having an outer circumferential surface of a first diameter facing an inner circumferential surface of the temperature-raising pipe forming the coil-shaped flow path, or a cylindrical second inner wall having an outer circumferential surface of a second diameter smaller than the first diameter facing the inner circumferential surface of the temperature-raising pipe.

The another superheater according to the present disclosure further includes a cylindrical first inner wall having an outer circumferential surface of a first diameter facing an inner circumferential surface of the temperature-raising pipe forming the coil-shaped flow path, and a cylindrical outer wall having an inner circumferential surface of a third diameter larger than the first diameter facing the outer circumferential surface of the temperature-raising pipe.

The another superheater according to the present disclosure further includes a cylindrical first inner wall having an outer circumferential surface of a first diameter facing an inner circumferential surface of the temperature-raising pipe forming the coil-shaped flow path, or a cylindrical second inner wall having an outer circumferential surface of a second diameter smaller than the first diameter facing the inner circumferential surface of the temperature-raising pipe, and a cylindrical outer wall having an inner circumferential surface of a third diameter larger than the first diameter facing the outer circumferential surface of the temperature-raising pipe.

The another superheater according to the present disclosure further includes a downward straight pipe connected to the inlet port, the downward straight pipe causing the steam discharged from the exit of the boiler to descend and to be guided toward the temperature-raising pipe; and an upward straight pipe connected to a lower end of the temperature-raising pipe connected to the downward straight pipe, the upward straight pipe causing the steam temperature-raised to ascend and to be guided toward the outlet port, in which the downward straight pipe and the upward straight pipe are orthogonal to an upper or lower surface of the furnace.

According to the present disclosure, it may provide an apparatus for raising the temperature of superheated steam capable of enhancing the flow of superheated steam in the process of raising the temperature by further heating superheated steam caused by waste heat generated in a waste combustion apparatus or the like, and at the same time, increasing the area of contact of the superheated steam with a heat source to improve the temperature-raising efficiency.

Further, the present disclosure may provide an economically superior apparatus for raising the temperature of superheated steam, in which the apparatus uses waste heat of a waste combustion apparatus or the like to raise the temperature of a heat source transferred to an apparatus requiring a high temperature such as a hydrogen generator with high heat and to transfer it to the hydrogen generator, thereby allowing high heat necessary for hydrogen generation to be constantly supplied to the hydrogen generator so as to produce high quality hydrogen smoothly and allowing one to obtain high heat easily using the waste heat.

Further, the present disclosure includes a boiler; a superheater including an inlet port connected to an exit side of the boiler, into which steam discharged from the exit of the boiler is introduced, an outlet port for discharge steam introduced through the inlet port, a temperature-raising pipe for interconnecting the inlet port and the outlet port and forming a coil-shaped flow path for raising the temperature of the steam introduced through the inlet port; and a furnace having a space into which the superheater is built, the furnace including a gas inlet port into which combustion gas is introduced, and a gas outlet port through which the combustion gas is discharged, the combustion gas introducing from the gas inlet port and transferring convection heat to the superheater. Therefore, steam production at an ultra-high temperature may be smoothly performed through heat transfer with high temperature combustion gas. Also, it is possible to obtain a large amount of high-quality steam for producing hydrogen to be used in a hydrogen production apparatus.

Further, the superheater according to the present disclosure further includes a cylindrical first inner wall having an outer circumferential surface of a first diameter facing an inner circumferential surface of the temperature-raising pipe forming the coil-shaped flow path. Therefore, it is possible to increase the residence time of the combustion gas and further improve the heat exchange efficiency through the convection heat by the combustion gas and the radiation heat by the external heat source.

Further, the superheater according to the present disclosure further includes a cylindrical first inner wall having an outer circumferential surface of a first diameter facing an inner circumferential surface of the temperature-raising pipe forming the coil-shaped flow path, or a cylindrical second inner wall having an outer circumferential surface of a second diameter smaller than the first diameter facing the inner circumferential surface of the temperature-raising pipe. Therefore, it is possible to increase the residence time of the combustion gas and further improve the heat exchange efficiency through the convection heat by the combustion gas and the radiation heat by the external heat source. Moreover, it is possible to drastically improve the temperature raising effect of the steam discharged through the outlet port.

Further, the superheater according to the present disclosure further includes a cylindrical first inner wall having an outer circumferential surface of a first diameter facing an inner circumferential surface of the temperature-raising pipe forming the coil-shaped flow path, and a cylindrical outer wall having an inner circumferential surface of a third diameter larger than the first diameter facing the outer circumferential surface of the temperature-raising pipe. Therefore, it is possible to supply the combustion gas to the space between the first inner wall and the outer wall, thereby intensively supplying heat energy and increasing the heat exchange efficiency as the residence time of the combustion gas increases. Moreover, it is possible to minimize adverse effects due to the dust of the combustion gas.

Further, the superheater according to the present disclosure further includes a cylindrical first inner wall having an outer circumferential surface of a first diameter facing an inner circumferential surface of the temperature-raising pipe forming the coil-shaped flow path, or a cylindrical second inner wall having an outer circumferential surface of a second diameter smaller than the first diameter facing the inner circumferential surface of the temperature-raising pipe, and a cylindrical outer wall having an inner circumferential surface of a third diameter larger than the first diameter facing the outer circumferential surface of the temperature-raising pipe. Therefore, it is possible to supply the combustion gas to the space between the first inner wall and the outer wall or the space between the second inner wall and the outer wall, thereby intensively supplying heat energy and increasing the heat exchange efficiency as the residence time of the combustion gas increases. Moreover, it is possible to minimize adverse effects due to the dust of the combustion gas.

Further, the superheater according to the present disclosure further includes a downward straight pipe connected to the inlet port, the downward straight pipe causing the steam discharged from the exit of the boiler to descend and to be guided toward the temperature-raising pipe; and an upward straight pipe connected to a lower end of the temperature-raising pipe connected to the downward straight pipe, the upward straight pipe causing the steam temperature-raised to ascend and to be guided toward the outlet port, in which the downward straight pipe and the upward straight pipe are orthogonal to an upper or lower surface of the furnace. Therefore, it is possible to further improve the heat exchange efficiency through the convection heat by the combustion gas and the radiation heat by the external heat source by allowing a flow of the steam supplied through the inlet port to be delayed to some extent through the temperature-raising pipe.

DETAILED DESCRIPTION

Figure 1:
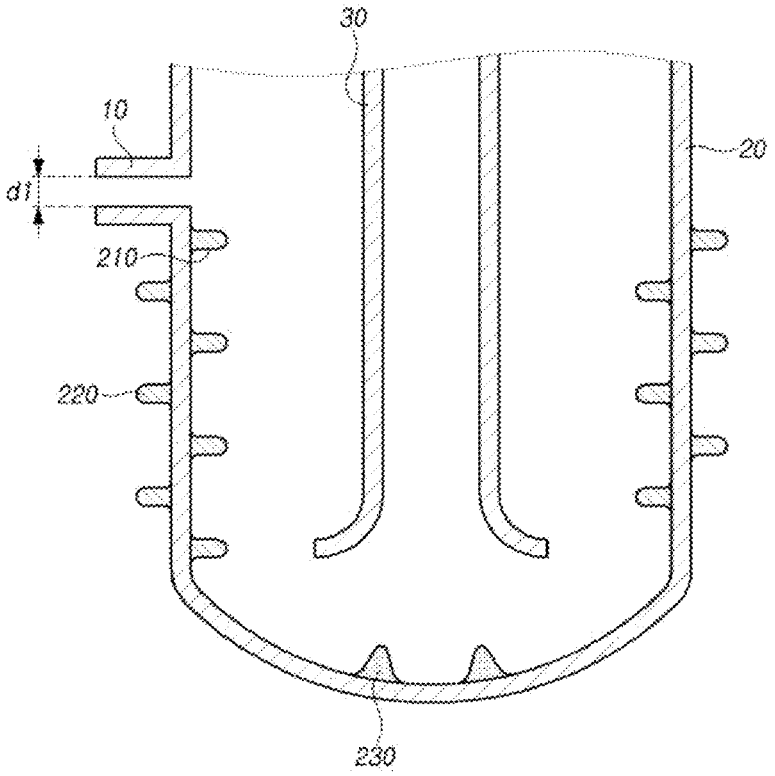
FIG. 1 shows a conceptual cross-sectional view of a superheater and an apparatus for raising the temperature according to an embodiment of the present disclosure.

Specific structural or functional descriptions for embodiments in accordance with the inventive concepts disclosed herein are merely illustrative for the purpose of illustrating embodiments in accordance with the concepts of the present disclosure. The embodiments according to the concepts of the present disclosure may be implemented in various forms and are not limited to the embodiments described herein.

The embodiments in accordance with the concepts of the present disclosure may be variously modified and may take various forms, so that the embodiments are illustrated in the drawings and described in detail herein. However, it is not intended to limit the embodiments according to the concepts of the present disclosure to the particular forms disclosed, but includes all modifications, equivalents, or alternatives falling within the spirit and scope of the present disclosure.

The terms first, second, etc. may be used to describe various elements, but the elements should not be limited by the terms. The terms may only be referred for the purpose of distinguishing one component from another. For example, a first component may be referred to as a second component, and similarly, the second component may also be referred to as the first component, without departing from the scope of rights in accordance with the concepts of the present disclosure.

It is to be understood that when a component is referred to as being "coupled" or "connected" to other components, it means that it may be directly coupled or connected to other components but it is possible for other components to exist in between. On the other hand, when a component is referred to as being "directly coupled" or "directly connected" to other components, it should be understood that there are no other components in between. Other expressions that describe the relationship between components, such as "between" and "right between" or "neighboring to" and "directly neighboring to" and the like should be interpreted as well.

The terms used herein is for the purpose of describing particular embodiments only and is not intended to be limiting of the present disclosure. Singular expressions include plural expressions unless the context clearly dictates otherwise. Herein, the terms such as "comprise" or "have" are intended to specify the presence of stated features, integers, steps, operations, components, parts, or combinations thereof. It should be understood that they do not preclude the possibility of presence or addition of one or more other features, numbers, steps, operations, components, parts, or combinations thereof.

Unless otherwise defined, all terms used herein, including technical or scientific terms, have the same meaning as commonly understood by one of ordinary skill in the art to which the present disclosure belongs. The terms such as those defined in commonly used dictionaries are to be interpreted as having a meaning consistent with the meaning of the context in the relevant art. Unless explicitly defined herein, they are not interpreted as an ideal or overly formal meaning.

Hereinafter, preferred embodiments of the present disclosure will be described in detail with reference to the accompanying drawings.

Figure 2:
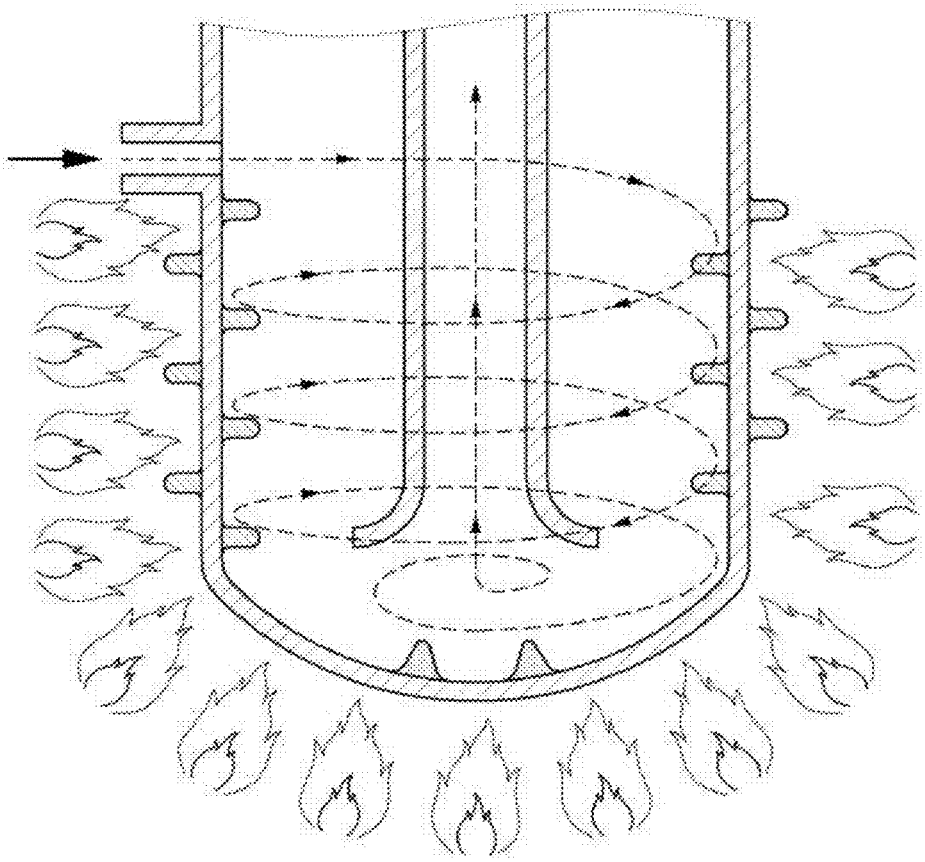
FIG. 2 shows a conceptual perspective view of a superheater and an apparatus for raising the temperature according to an embodiment of the present disclosure.

FIG. 1 shows a conceptual cross-sectional view of a superheater and an apparatus for raising the temperature according to an embodiment of the present disclosure, and FIG. 2 shows a conceptual perspective view of a superheater and an apparatus for raising the temperature according to an embodiment of the present disclosure.

Referring to FIGS. 1 and 2, a superheater and an apparatus for raising the temperature according to an embodiment of the present disclosure includes an inlet 10, a body 20, and an outlet 30.

The inlet 10 functions as a flow path through which superheated steam is introduced.

For example, the inlet 10 may be provided in an upper region, which is the opposite region of a bottom region of the body 20, and the superheated steam may be introduced into the body 20 through the inlet 10 while being pressurized at high pressure.

For example, the superheated steam may be steam heated by waste heat generated in a waste combustion apparatus or the like, but the superheated steam is not limited thereto.

A line extended from an inner flow path of the inlet 10 may be the same as a tangent of an inner surface of a sidewall of the body 20. The superheated steam introduced into the body 20 from the inlet 10 through such a structure may be introduced into a tangential direction of the inner surface of the sidewall of the body 20. The superheated steam introduced into the tangential direction of the inner surface of the sidewall of the body 20 may flow along the inner surface of the sidewall of the body 20.

The body 20 is heated by an external heat source and functions to raise the temperature of the superheated steam introduced through the inlet 10. In other words, the body 20 is a component that is heated by an external heat source, and may be composed of any material with good thermal conductivity and durability. The body 20 may have a substantially cylindrical shape, but the shape of it is not limited thereto.

The outlet 30 is a portion for discharging the superheated steam temperature-raised in the body 20 to the outside. The outlet 30 may be arranged while forming a flow path in an up and down direction in the center of the body 20. The superheated steam injected from the inlet 10 flows downward (the gravity direction) of the body 20 while being heated in the body 20. The superheated steam temperature-raised by this heating may be discharged upward along the flow path of the outlet 30 from a lower side of the body 20.

The outlet 30 may be connected to a hydrogen generator. Here, the hydrogen generator is an apparatus for electrolyzing water using an electrochemical cell. The hydrogen generator may produce hydrogen more efficiently by receiving the superheated steam temperature-raised in the body 20.

Referring to FIG. 2, a heat source may be applied to the sidewall and the bottom of the body 20. The superheated steam is moved downward while flowing along the inner surface of the sidewall of the body 20 from the upper side of the body 20 in order to receive more heat from the external heat source, and then, may be discharged through the outlet 30 in the center of the body 20.

When the superheated steam is regarded as a particle or a lump, an amount of heat supplied to the superheated steam varies depending on the length of the flow path. When the length of the flow path is long, the amount of heat supplied to the superheated steam is increased, and when the length of the flow path is short, the amount of heat supplied to the superheated steam is reduced.

Further, the amount of heat supplied to the superheated steam varies depending on a distance from the sidewall of the body 20. When the superheated steam is brought into close contact with the sidewall of the body 20, the amount of heat supplied thereto is increased, and when the superheated steam is away from the sidewall, the amount of heat supplied thereto is reduced.

Considering such a principle, when the superheated steam flows into a spiral flow path in close contact with the inner surface of the sidewall of the body 20, the largest amount of heat is supplied to the superheated steam.

FIG. 2 shows that the superheated steam flows into the spiral flow path in close contact with the inner surface of the sidewall of the body 20. The superheated steam injected through the inlet 10 may move to the lower side of the body 20 while flowing spirally along the inner surface of the sidewall in the cylindrical body 20, and then, be discharged to the outside along the flow path of the outlet 30 while rising from the bottom of the body 20.

An inner protrusion 210 for heating the superheated steam while spirally rotating is formed on the inner surface of the sidewall of the body 20. The inner protrusion 210 functions as a guide for a path of superheated steam.

Figure 3:
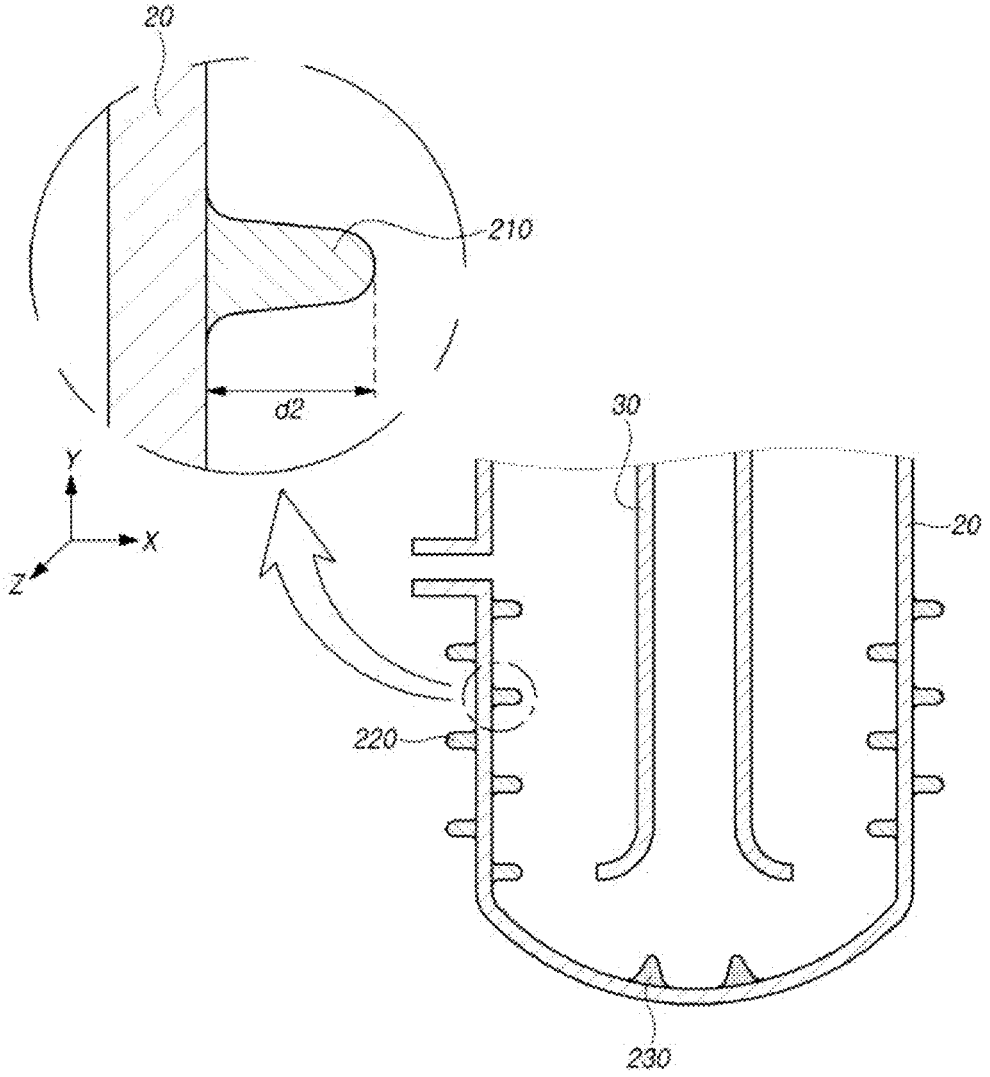
FIG. 3 shows a view of one exemplary configuration of an inner protrusion in an embodiment of the present disclosure.

As one example, referring to FIG. 3, which shows one exemplary configuration of the inner protrusion 210, the inner protrusion 210 may protrude from the inner surface of the sidewall of the body 20 and may have a spiral projection shape extending obliquely toward the inner surface of the bottom of the body 20. According to the configuration, the superheated steam introduced through the inlet 10 is induced as a first swirl while being spirally rotated by the inner protrusion 210, thereby primarily allowing a flow of the superheated steam to be enhanced, and at the same time, allowing the heating efficiency to be increased by increasing a contact area with the inner protrusion 210 heated by the external heat source.

Here, the first swirl is a swirl formed in a plane (ZX plane) perpendicular to the gravity direction (Y direction), and forms a main path of the superheated steam.

The inner protrusion 210 is formed to protrude in a direction (X direction) perpendicular to the sidewall of the body 20, in which a portion contacting with the superheated steam in a portion where the inner protrusion 210 and the inner surface of the sidewall are connected may have a concave shape. The concave shape is intended to soften the flow of the superheated steam and may reduce the occurrence of turbulence.

The superheated steam flows in the tangential direction (Z direction) of the body 20 by the inner protrusion 210 and flows downward (the negative direction in the Y direction) by gravity.

The inner protrusion 210 may be inclined in the gravity direction (Y direction) with a certain angle with the tangential direction (Z direction) of the body 20. The superheated steam may be accelerated in the downward direction according to the angle.

An injection path of the inlet 10 may also be inclined in the gravity direction (Y direction) with a certain angle with the tangential direction (Z direction) of the body 20. The superheated steam may be accelerated in the downward direction according to an injection angle.

Figure 4:
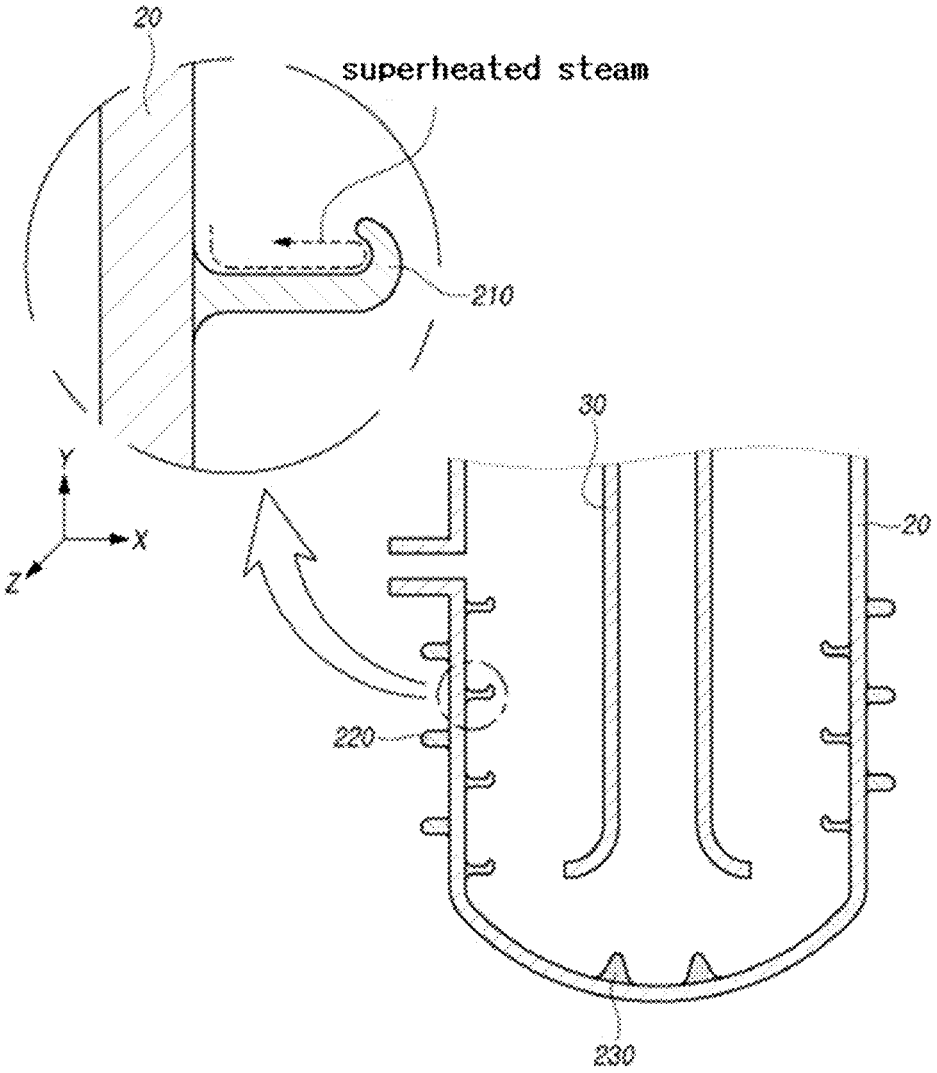
FIG. 4 shows a view of another exemplary configuration of an inner protrusion in an embodiment of the present disclosure.

As another example, further referring to FIG. 4, which shows another exemplary configuration of the inner protrusion 210, the inner protrusion 210 may protrude from the inner surface of the sidewall of the body 20 and may have a spiral projection shape extending obliquely toward the inner surface of the bottom of the body 20, in which an end of the inner protrusion 210 may have a shape bent upward in parallel with the inner surface of the sidewall of the body 20. According to the configuration, the superheated steam introduced through the inlet 10 and induced as the first swirl by the inner protrusion 210 is induced as a second swirl by the end of the inner protrusion, thereby secondarily allowing a flow of the superheated steam to be enhanced, and at the same time, allowing the heating efficiency to be increased by increasing a contact area with the inner protrusion 210 heated by the external heat source.

If the first swirl is formed in the ZX plane, the second swirl may be formed in the XY plane. The XY plane is a plane formed by the up and down direction of the sidewall and the protruding direction of the inner protrusion 210 (a direction perpendicular to the sidewall). The swirl in the XY plane may evenly mix the entire superheated steam. Further, the contact time with the inner surface of the sidewall of the body 20 increases, so that more heat may be supplied to the superheated steam.

The end of the inner protrusion 210 bends upward in parallel with the inner surface of the sidewall, and then bends again in a direction of an inner surface of a side. Therefore, the superheated steam directed from the inner surface of the side toward the end of the inner protrusion 210 may be returned back to a direction of the inner surface of the sidewall.

A protruding height d2 of the inner protrusion 210 for increasing the flow of the superheated steam may be larger than a diameter d1 of the inlet 10.

Figure 5:
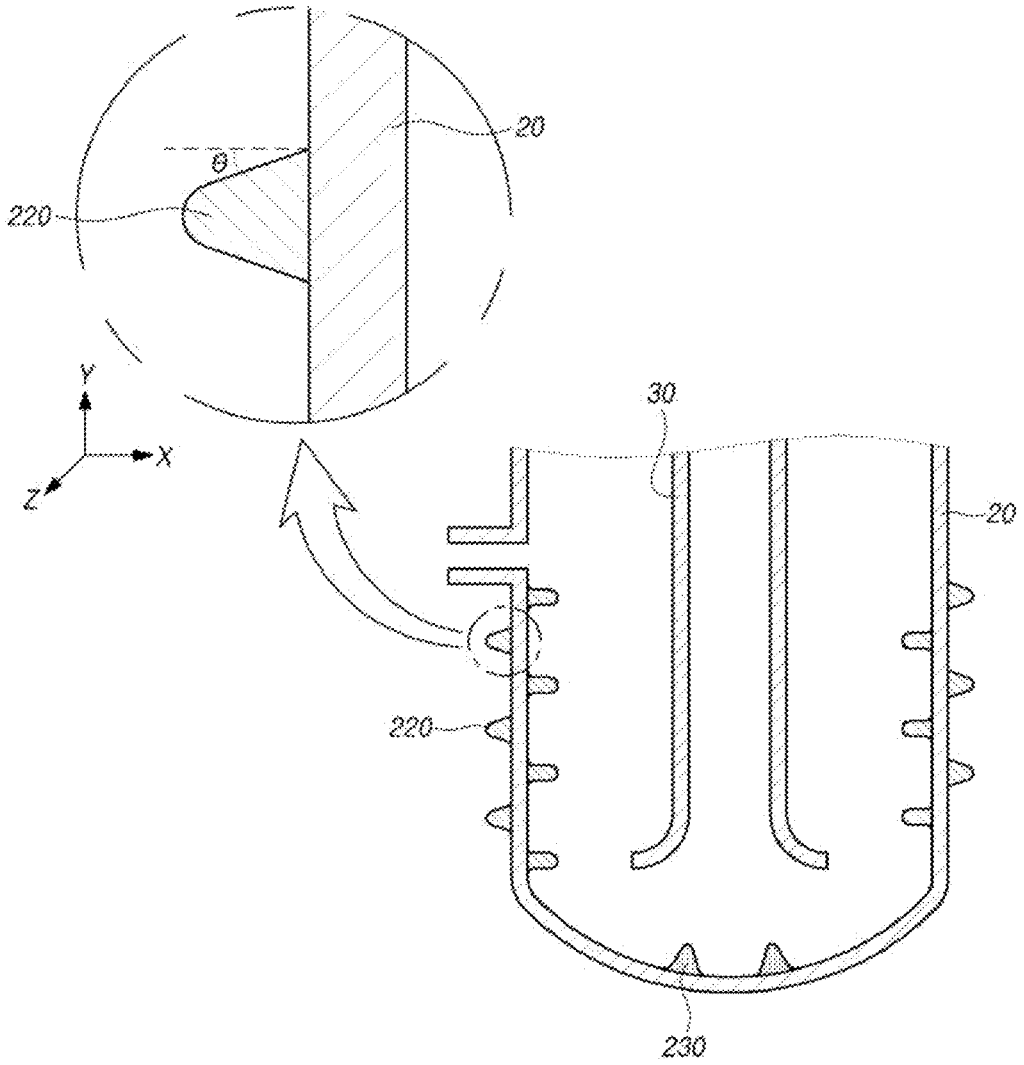
FIG. 5 shows a view of an exemplary configuration of an outer protrusion in an embodiment of the present disclosure.

For example, further referring to FIG. 5, which shows an exemplary configuration of an outer protrusion 220, an outer surface of the sidewall of the body 20 may be formed with the outer protrusion 220 for increasing an area exposed to the external heat source to increase the heating efficiency.

For example, the outer protrusion 220 may protrude from the outer surface of the sidewall of the body 20 and have a shape inclined downwardly of the body 20. The reference numeral θ in FIG. 5 denotes an angle between the outer protrusion 220 and a surface perpendicular to the outer surface of the sidewall of the body 20. According to the configuration, foreign substances such as ash generated in the waste combustion apparatus are not accumulated in the outer protrusion 220 but flows down and are removed. Therefore, it facilitates the maintenance of the apparatus for raising the temperature of superheated steam, and it is possible to prevent in advance the deterioration of heat transfer efficiency due to ash or the like deposited on the outer protrusion 220.

Figure 6:
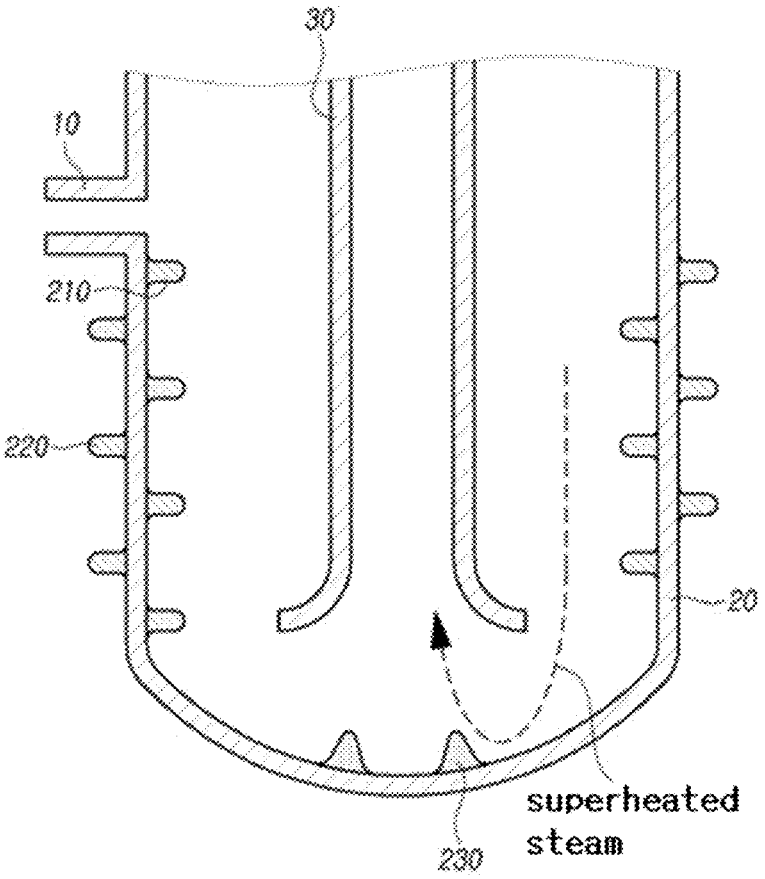
FIG. 6 shows a view of an exemplary configuration of a bottom protrusion in an embodiment of the present disclosure.

For example, further referring to FIG. 6, which shows an exemplary configuration of a bottom protrusion 230, the bottom protrusion 230 may be formed on the inner surface of the bottom of the body 20 for rising the superheated steam and guiding the superheated steam to the lower end of the outlet 30. According to the configuration, when the superheated steam introduced through the inlet 10 reaches the inner surface of the bottom of the body 20 in the form of a swirl while being spirally rotated by the inner protrusion 210 formed on the inner surface of the sidewall of the body 20, the superheated steam rises along the surface of the bottom projection 230, which protrudes from the inner surface of the bottom of the body 20 toward a lower end of the outlet 30, and is intensively guided to the lower end of the outlet 30. Therefore, the heat discharge efficiency is increased.

Figure 7:
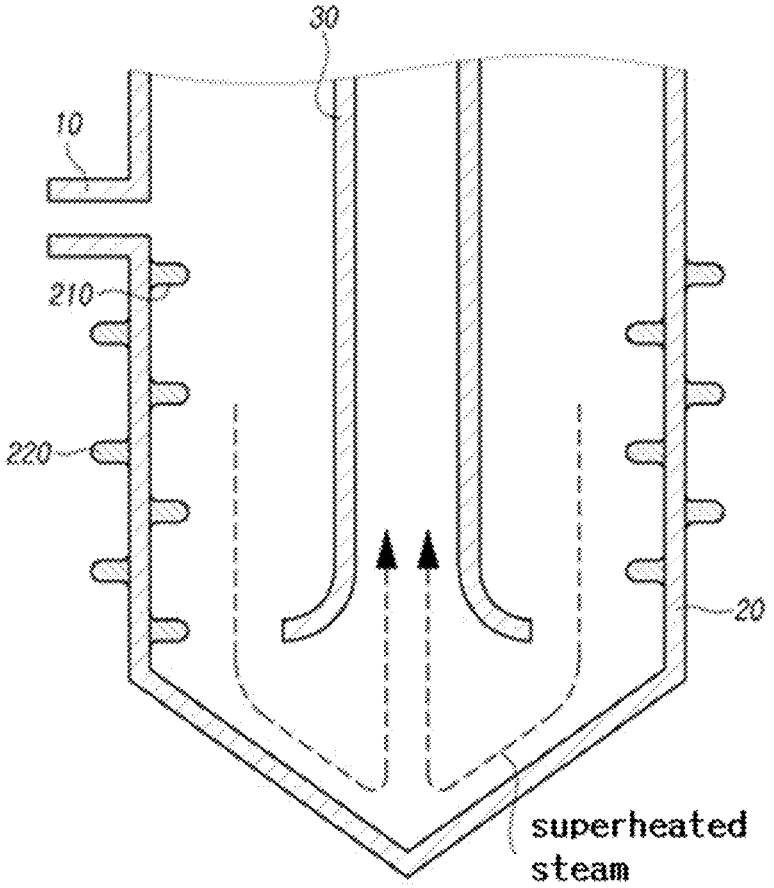
FIG. 7 shows a view of an exemplary configuration of a body in an embodiment of the present disclosure.

For example, further referring to FIG. 7, which shows an exemplary configuration of the body 20, the inner surface of the bottom of the body 20 may have a cone shape inverted with respect to the lower end of the outlet 30. According to the configuration, the superheated steam is concentrated in a vertex region of the inner surface of the bottom of the body 20 having a cone shape, and then rises and is introduced into the lower end of the outlet 30 to discharge to the outside, thereby increasing the heat discharge efficiency.

The outlet 30 is provided inside the body 20 and discharges the superheated steam temperature-raised by the body 20 heated by the external heat source to the outside.

For example, the outlet 30 may be arranged in the central region of the body 20. When the body 20 has a cylindrical shape, the outlet 30 may have a cylindrical shape with a smaller diameter than the body 20.

For example, the lower end of the outlet 30 may have an opening shape that is opened toward the inner surface of the bottom of the body 20 in a state of being spaced apart from the inner surface of the bottom of the body 20. According to the configuration, the superheated steam guided to the inner surface of the bottom of the body 20 by the inner protrusion 210 is introduced into the lower end of the outlet 30 having the opening shape that is opened toward the inner surface of the bottom of the body 20 and is discharged to the outside, thereby increasing the heat discharge efficiency.

Figure 8:
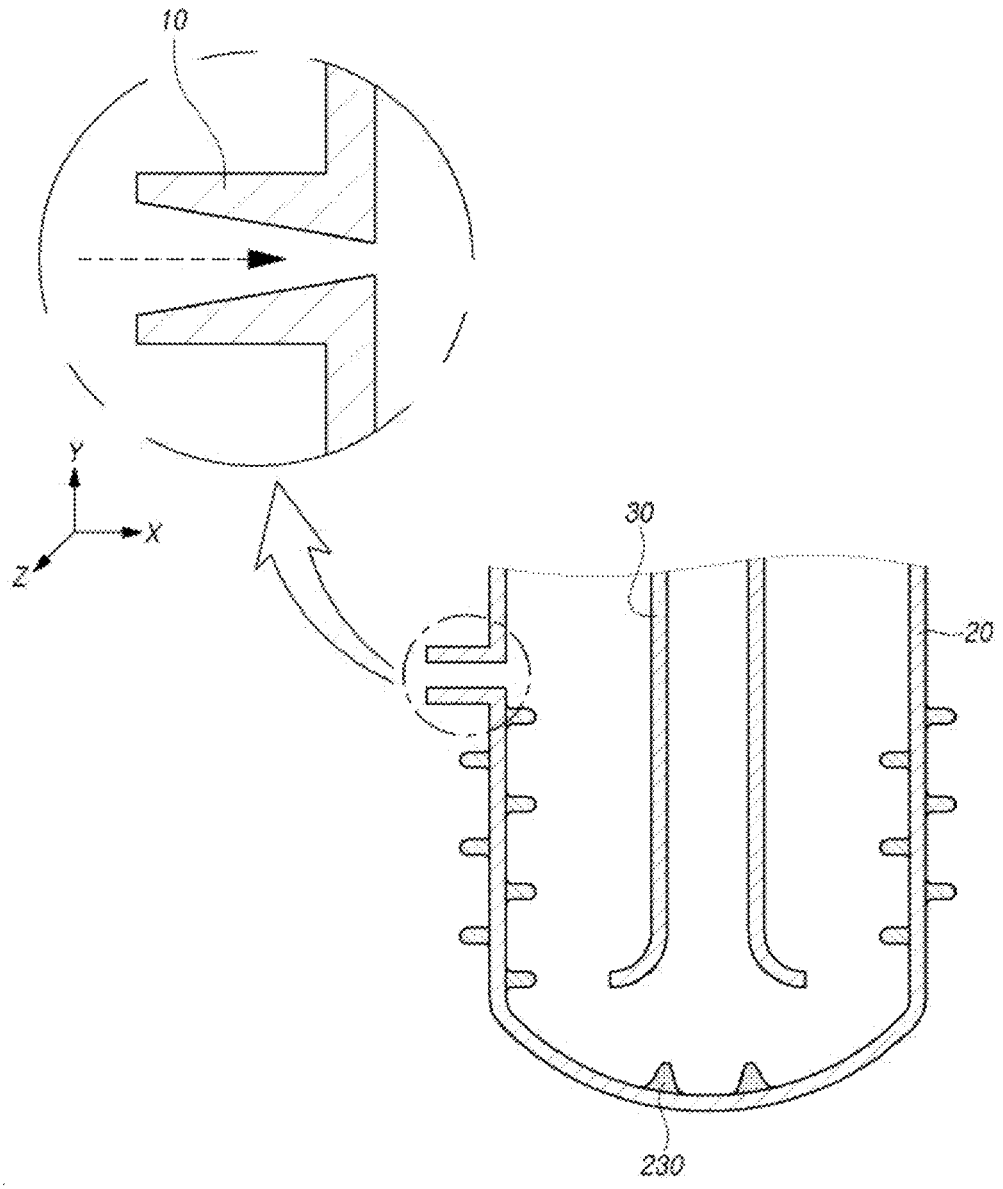
FIG. 8 shows a view of an exemplary configuration of an inlet in an embodiment of the present disclosure.

FIG. 8 shows a view of an exemplary configuration of an inlet in an embodiment of the present disclosure.

Referring to FIG. 8, the flow path, through which the superheated steam flows, in the inlet 10 may have a shape in which the cross-sectional area gradually decreases.

With this configuration, the rate of the superheated steam injected into the body 20 from the inlet portion 10 may be accelerated. The superheated steam flows along the inner surface of the sidewall of the body 20, in which when the rate of the superheated steam increases, the centrifugal force is stronger and the time for the superheated steam to closely contact the inner surface of the sidewall of the body 20 is increased.

Further, when the flow path of a portion where the inlet 10 and the body 20 are connected becomes small, a passage of the superheated steam is narrow, and a cross-section of a path through which the superheated steam is injected becomes small. When the cross-section of the path through which the superheated steam is injected is wide, an amount of the superheated steam contacting the sidewall of the body 20 is reduced, thereby reducing the received heat. According to the shape above, as the cross-section of the path through which the superheated steam is injected becomes small, the amount of the superheated steam contacting the sidewall increases.

Figure 9:
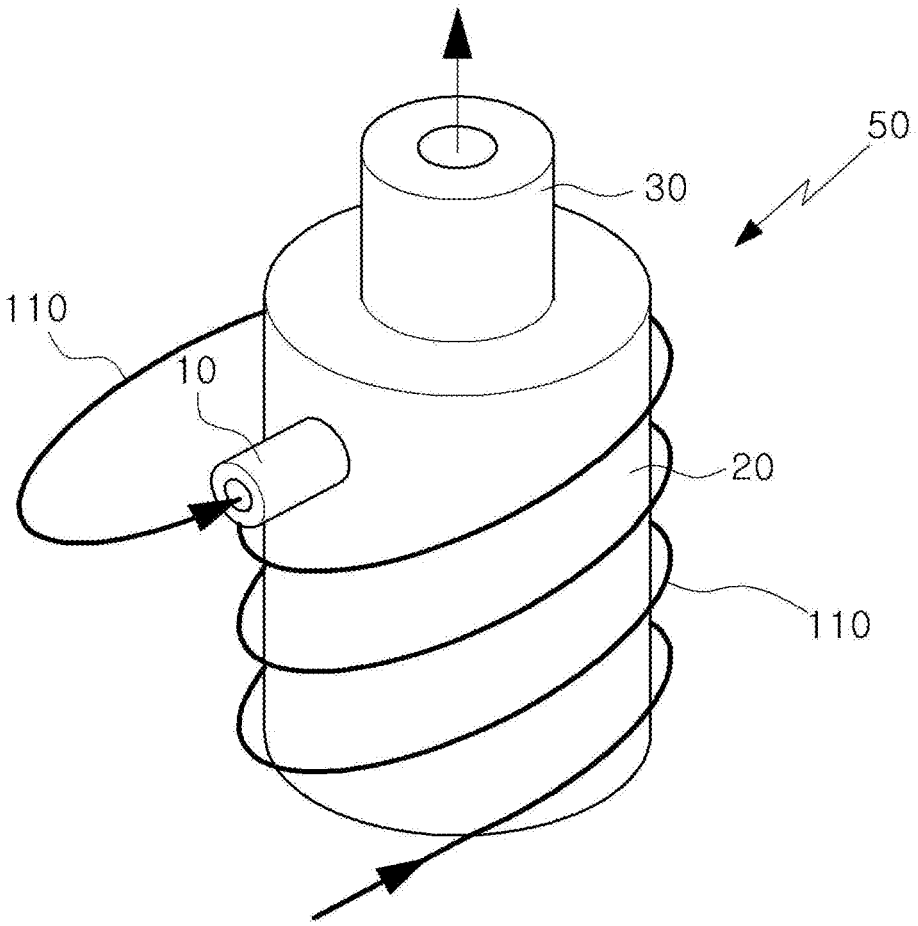
FIG. 9 shows a view of one exemplary configuration of a steam pipe in an embodiment of the present disclosure.
Figure 10:
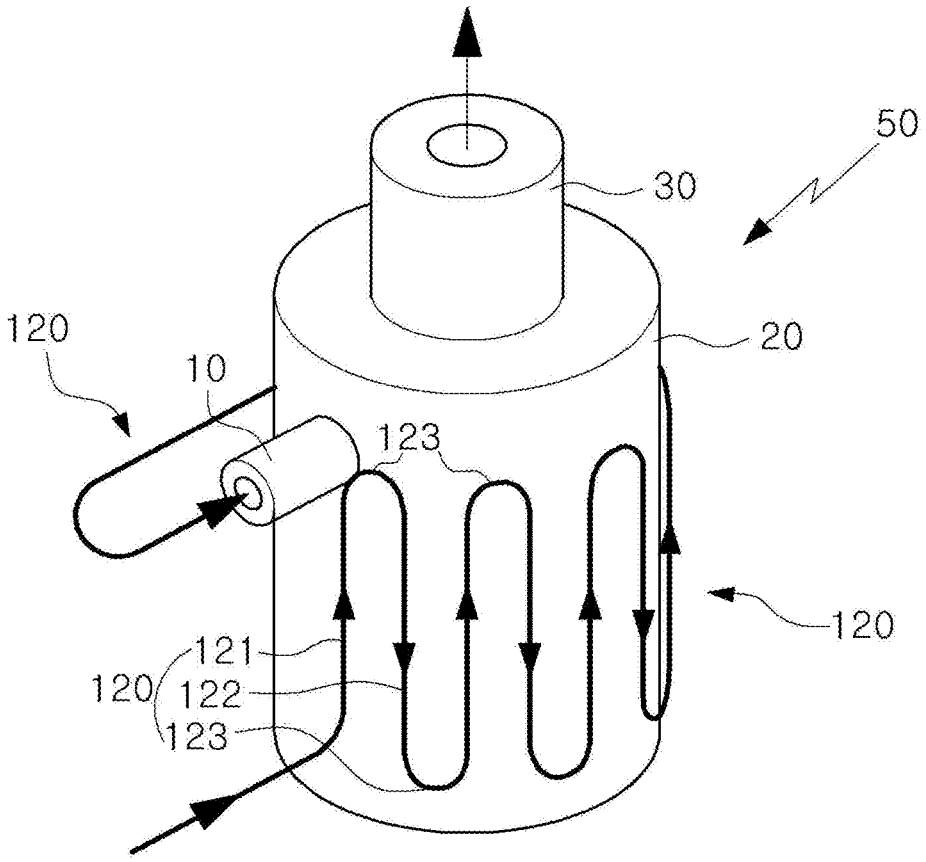
FIG. 10 shows a view of another exemplary configuration of a steam pipe in an embodiment of the present disclosure.

FIGS. 9 and 10 show views of several exemplary configurations of a steam pipe in an embodiment of the present disclosure.

Referring to FIGS. 9 and 10, a steam pipe connected to the inlet 10 may be provided on the outer surface of the body 20 so as to form a flow path through which the superheated steam flows.

The foregoing steam pipe preheats the superheated steam flowing inside the steam pipe by the body 20. The steam pipe preheats the superheated steam through heat exchange with the external heat source (not shown) by surrounding the outside of the apparatus for raising the temperature of superheated steam 50 having a cylindrical shape, that is, the body 20, and supplies the preheated superheated steam through the inlet 10.

The steam pipe may be formed in a coil shape so as to surround the outer surface of the body 20. It can be seen that the steam pipe surrounds the body 20 in a horizontal or vertical direction with respect to an outer peripheral surface of the cylindrical body 20.

Referring to FIG. 9 in more detail, the steam pipe may include a first steam pipe 110 which forms a spiral flow path in an up and down vertical direction with respect to the outer peripheral surface of the body 20 and surrounds the outer peripheral surface of the body 20.

Further, referring to FIG. 10 in more detail, the steam pipe may include a second steam pipe 120 which forms a flow path through which the superheated steam flows in a meandering shape along a horizontal direction with respect to the outer circumferential surface of the body 20 and surrounds the outer circumferential surface of the body 20.

It can be seen that the second steam pipe 120 includes an upward pipe 121, a downward pipe 122, and a connecting pipe 123.

First, the upward pipe 121 forms a flow path through which the superheated steam flows from a lower side to an upper side with respect to the outer peripheral surface of the body.

The downward pipe 122 forms a flow path through which the superheated steam flows from the upper side to the lower side with respect to the outer peripheral surface of the body 20.

The connecting pipe 123 forms a flow path to connect an upper end of the upward pipe 121 and an upper end of the downward pipe 122, or to connect a lower end of the upward pipe 121 and a lower end of the downward pipe 122.

Accordingly, the second steam pipe 120 is formed by repeatedly disposing the upward pipe 121 and the connecting pipe 123, and the downward pipe 122 and the connecting pipe 123 with respect to the outer peripheral surface of the body 20.

According to the disclosure as described in detail above, it has an effect that provide an apparatus for raising the temperature of superheated steam capable of enhancing the flow of superheated steam in the process of raising the temperature by further heating superheated steam caused by waste heat generated in a waste combustion apparatus or the like, and at the same time, increasing the area of contact of the superheated steam with a heat source to improve the temperature-raising efficiency.

Further, it has an effect that provide an economically superior apparatus for raising the temperature of superheated steam, in which the apparatus uses waste heat of a waste combustion apparatus or the like to raise the temperature of a heat source transferred to an apparatus requiring a high temperature such as a hydrogen generator with high heat and to transfer it to the hydrogen generator, thereby allowing high heat necessary for hydrogen generation to be constantly supplied to the hydrogen generator so as to produce high quality hydrogen smoothly and allowing one to obtain high heat easily using the waste heat.

Figure 11:
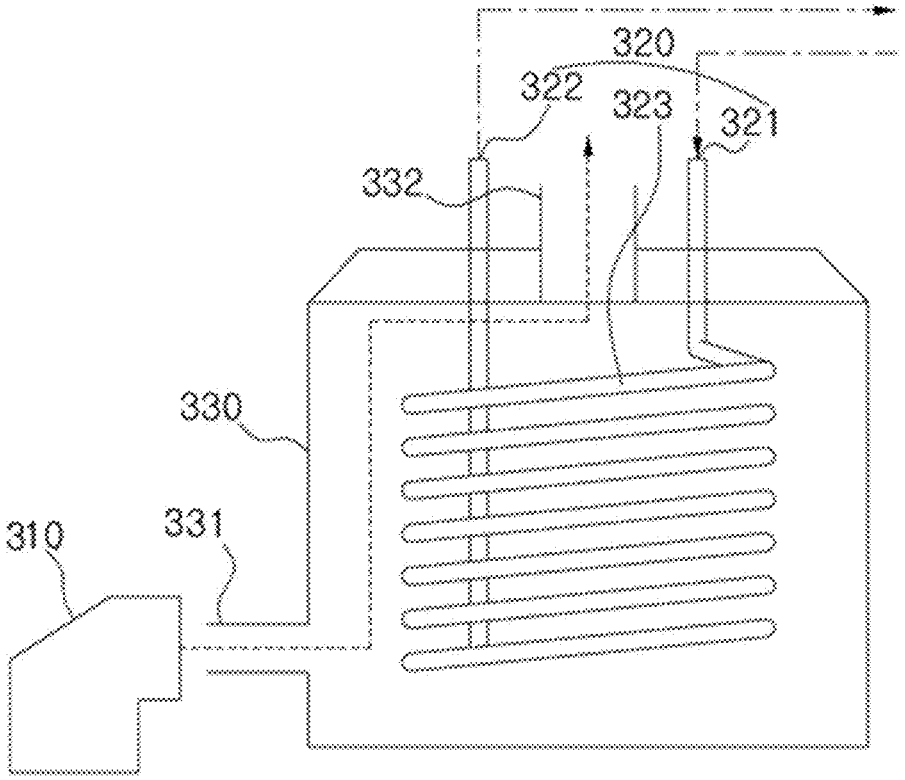
FIG. 11 shows a conceptual view schematically showing the overall configuration of an ultra-high temperature steam generator equipped with a coil type superheater according to an embodiment of the present disclosure.

FIG. 11 shows a conceptual view schematically showing the overall configuration of an ultra-high temperature steam generator equipped with a coil type superheater according to an embodiment of the present disclosure.

Figure 12:
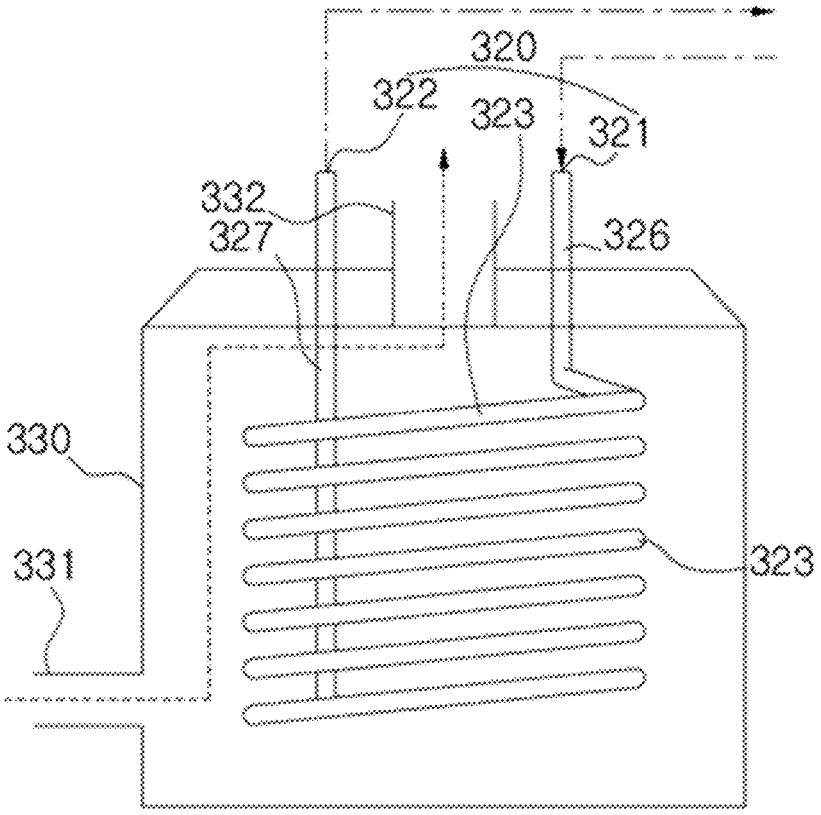
FIGS. 12, 13A, 13B, 14A and 14B are conceptual views schematically showing an internal structure of a superheater and a furnace, which are main parts of an ultra-high temperature steam generator equipped with a coil type superheater according to various embodiments of the present disclosure.
Figure 13A:
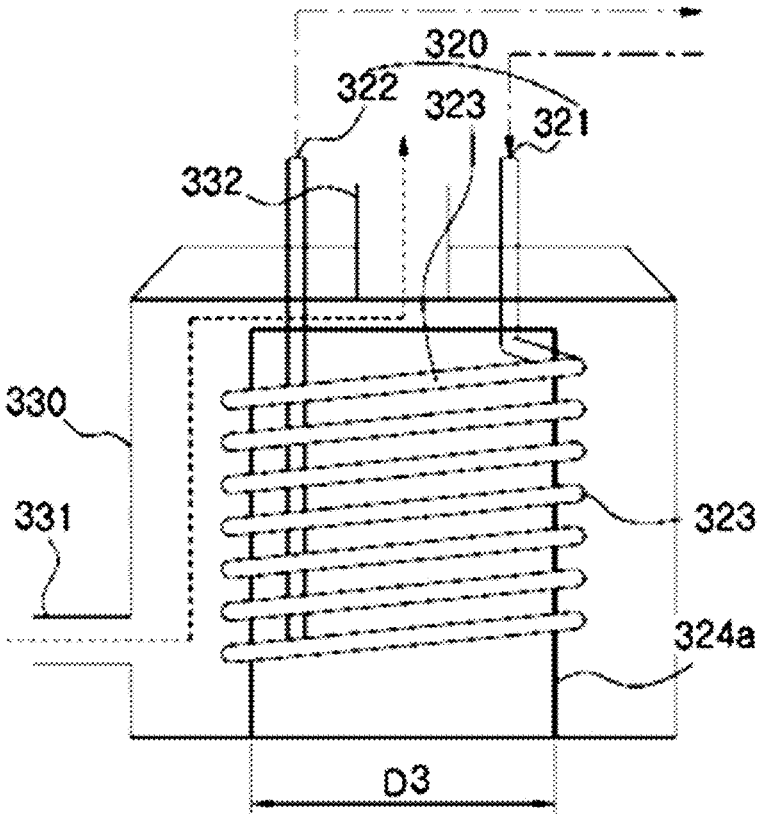
Figure 13B:
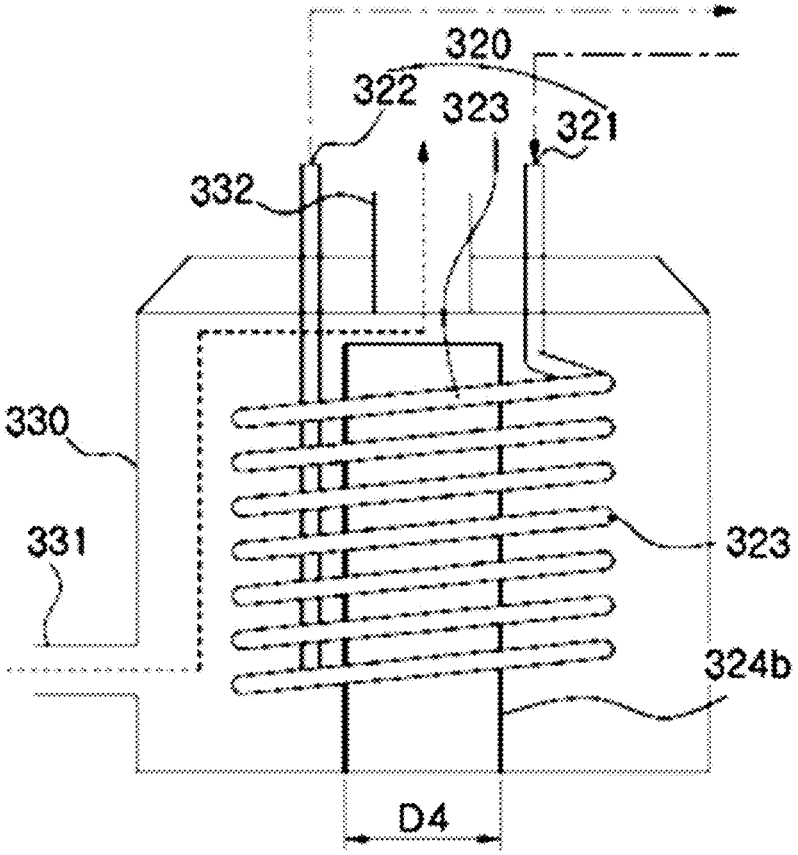
Figure 14A:
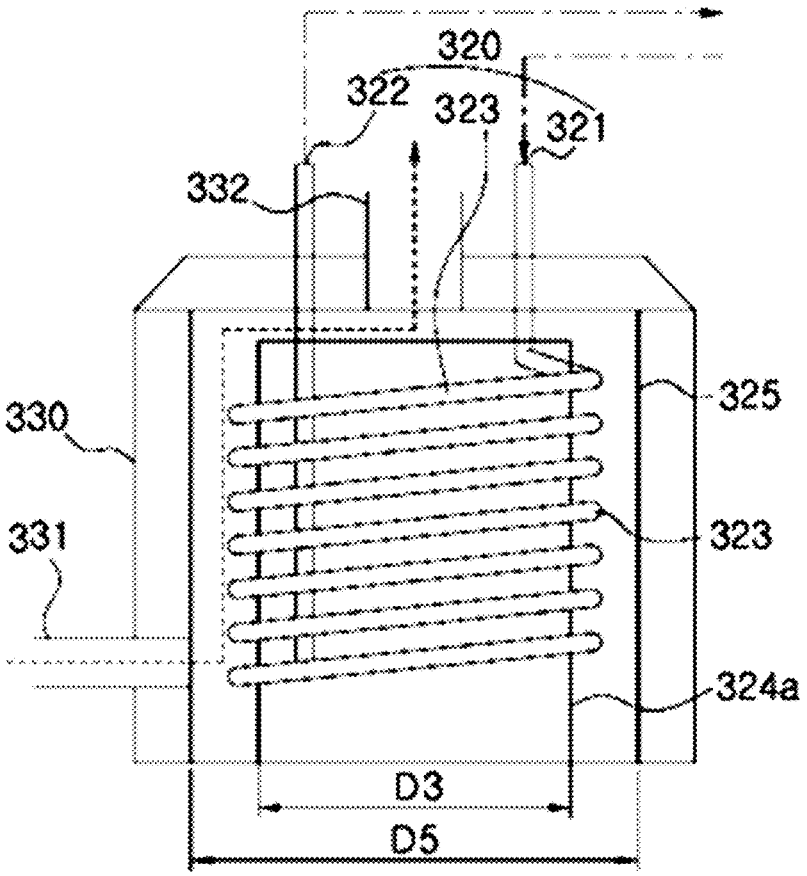
Figure 14B:
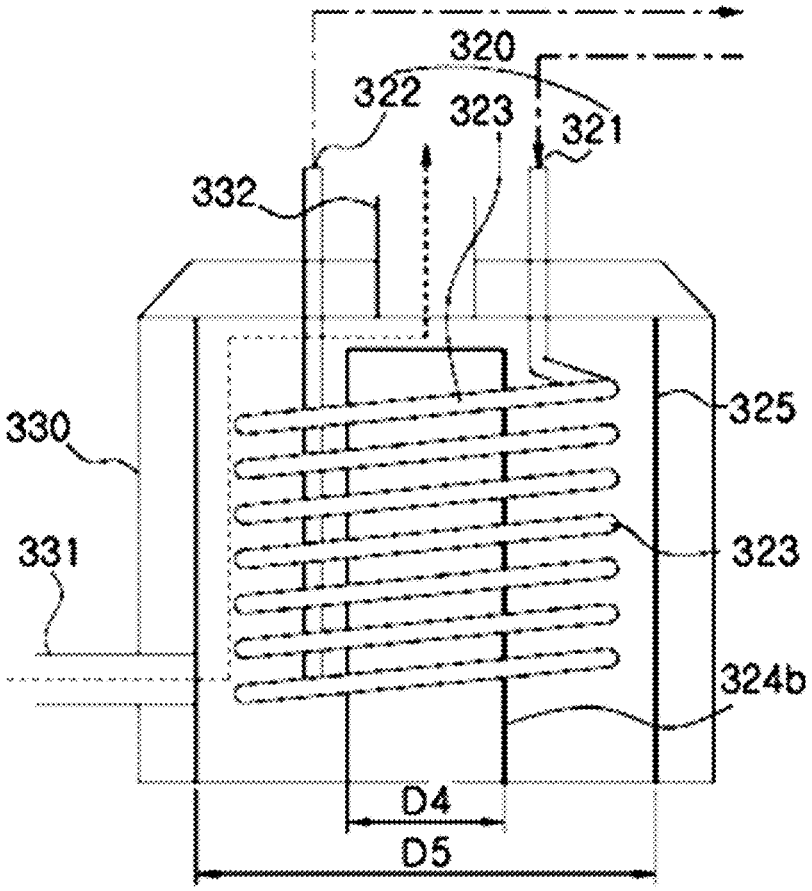

Further, FIGS. 12 to 14 B are conceptual views schematically showing an internal structure of a superheater 320 and a furnace 330, which are main parts of an ultra-high temperature steam generator equipped with a coil type superheater according to various embodiments of the present disclosure.

As shown in the drawings, the superheater 320 connected to a boiler 310 is built into the furnace 330. Here, the boiler 310 may be an SRF (solid refuse fuel) boiler, a gas boiler, a fossil fuel boiler, or the like. For the sake of clarity and ease of explanation, the boiler 310 will be described as an SRF boiler 310.

First, the superheater 320 includes an inlet port 321 connected to an exit side of the boiler 310 for introducing steam discharged from an exit of the SRF boiler 310, an outlet port 322 for discharge the steam introduced through the inlet port 321, a temperature-raising pipe 323 for connecting the inlet port 321 and the outlet port 322 and forming a coil-shaped flow path for raising the temperature of the steam introduced through the inlet port 321.

The furnace 330 has a space into which the superheater is built, and includes a gas inlet port 331 into which combustion gas is introduced and a gas outlet port 332 through which the combustion gas is discharged.

The embodiment as described above may be of course applied to the present disclosure, and the following various embodiments may also be applied to the present disclosure.

First, referring to FIG. 12 in connection with FIG. 11, the superheater 320 further includes a downward straight pipe 326 connected to the inlet port 321, the downward straight pipe causing the steam discharged from the exit of the SRF boiler 310 to descend and to be guided to a temperature-raising pipe 323 side; and an upward straight pipe 327 connected to a lower end of the temperature-raising pipe 323 connected to the downward straight pipe 326, the upward straight pipe causing the steam temperature-raised to ascend and to be guided to an outlet port 322 side.

Here, it can be seen that the downward straight pipe 326 and the upward straight pipe 327 are orthogonal to an upper or lower surface of the furnace 330.

Referring to FIGS. 13 A and 13 B, the superheater 320 may further include a cylindrical first inner wall 324*a* having an outer circumferential surface of a first diameter D3 facing an inner circumferential surface of the temperature-raising pipe 323 forming the coil-shaped flow path as shown in FIG. 13 A.

Also, the superheater 320 may further include a cylindrical second inner wall 324*b* having an outer circumferential surface of a second diameter D4 smaller than the first diameter D3 facing the inner circumferential surface of the temperature-raising pipe 323 as shown in FIG. 13 B.

As shown in FIGS. 14 A and 14 B, the superheater 320 may further include an outer wall 325 between the outer circumferential surface of each inner wall 324*a* or 324*b* and the inner circumferential surface of the furnace 330.

More specifically, as shown in FIG. 14 A, the superheater 320 may further include the cylindrical first inner wall 324*a* having an outer circumferential surface of the first diameter D3 facing the inner circumferential surface of the temperature-raising pipe 323 forming the coil-shaped flow path, or the cylindrical outer wall 325 having an inner circumferential surface of a third diameter D5 larger than the first diameter D3 facing the outer circumferential surface of the temperature-raising pipe 323.

Also, as shown in FIG. 14 B, the superheater 320 may further include the cylindrical second inner wall 324*b* having the outer circumferential surface of the second diameter D4 smaller than the first diameter D3 facing the inner circumferential surface of the temperature-raising pipe 323, or the cylindrical outer wall 325 having the inner circumferential surface of the third diameter D5 larger than the first diameter D3 facing the outer circumferential surface of the temperature-raising pipe 323.

Figure 15:
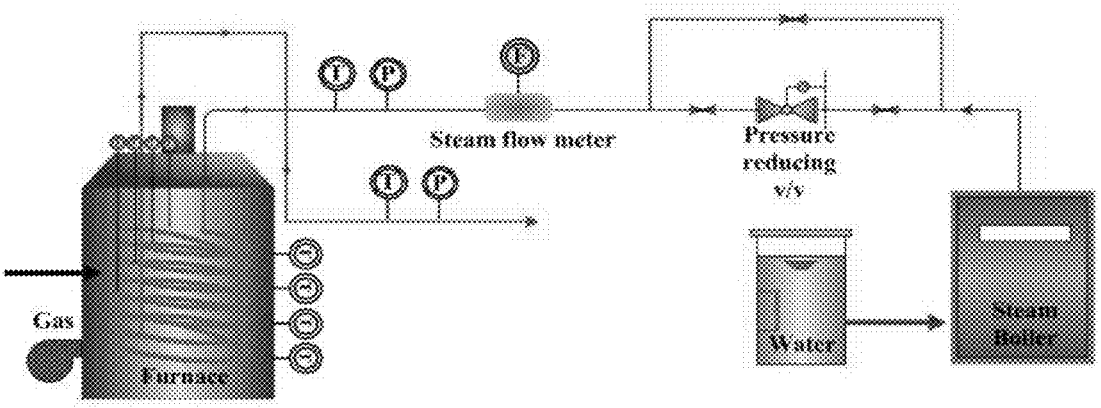
FIG. 15 shows an overall schematic view of a performance test system of a superheater, which is the main part of an ultra-high temperature steam generator equipped with a coil type superheater, according to an embodiment of the present disclosure.

Before building an incinerator system using the SRF boiler, the present inventor constructed a simulation system of a lab scale as shown in FIG. 15 in order to examine the possibility of ultra-high temperature steam production performance of the superheater installed therein, and conducted a basic experiment therefor.

For reference, FIG. 15 shows an overall schematic view of a performance test system of a superheater, which is the main part of an ultra-high temperature steam generator equipped with a coil type superheater, according to an embodiment of the present disclosure.

Figure 16:
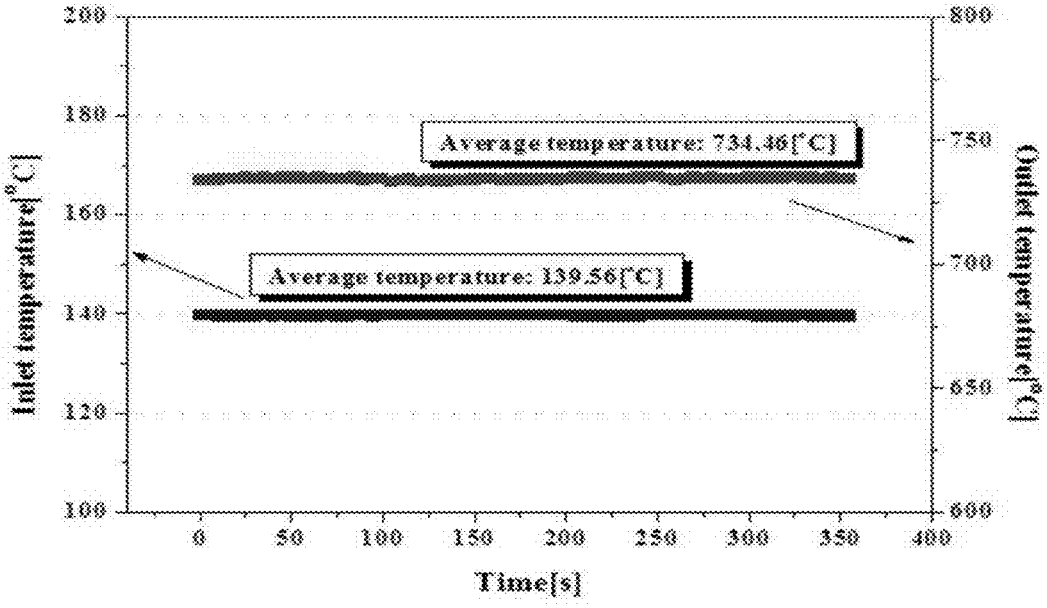
FIG. 16 shows a graph comparing the temperature of entry and exit of a superheater during a performance test of a superheater, which is the main part of an ultra-high temperature steam generator equipped with a coil type superheater, according to an embodiment of the present disclosure.
Figure 17:
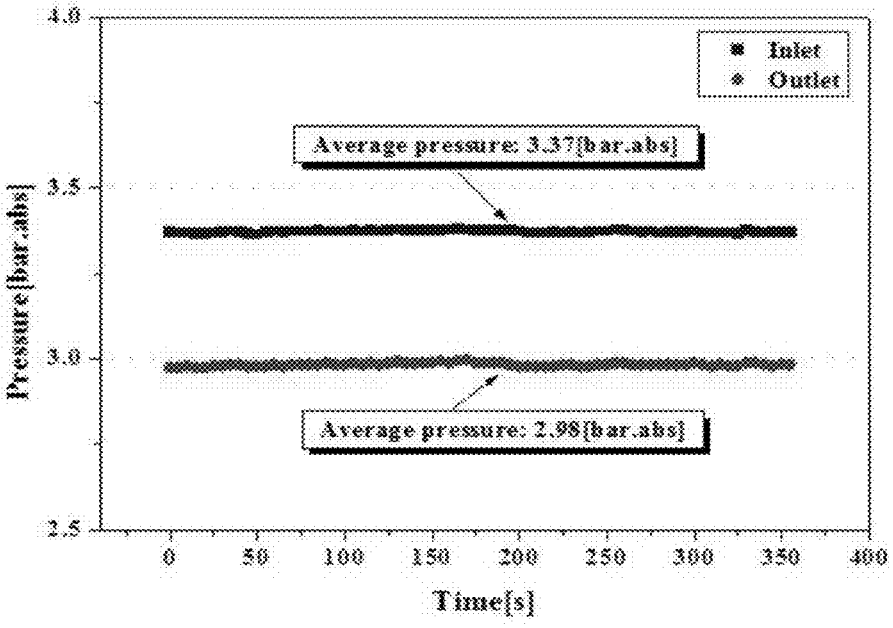
FIG. 17 shows a graph comparing the pressure of entry and exit of a superheater during a performance test of a superheater, which is the main part of an ultra-high temperature steam generator equipped with a coil type superheater, according to an embodiment of the present disclosure.

Also, FIG. 16 shows a graph comparing the temperature of an entry and exit of a superheater during a performance test of a superheater, which is the main part of an ultra-high temperature steam generator equipped with a coil type superheater, according to an embodiment of the present disclosure. FIG. 17 shows a graph comparing the pressure of an entry and exit of a superheater during a performance test of a superheater, which is the main part of an ultra-high temperature steam generator equipped with a coil type superheater, according to an embodiment of the present disclosure.

Figure 18:
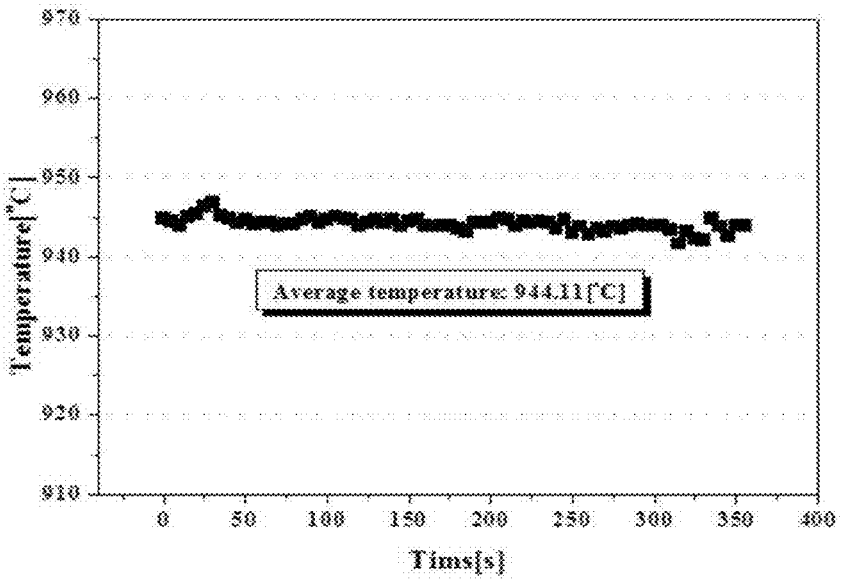
FIG. 18 shows a graph representing changes in the internal temperature of a furnace, that is, a furnace, which is the main part of an ultra-high temperature steam generator equipped with a coil type superheater, according to an embodiment of the present disclosure.

Also, FIG. 18 is a graph showing changes in the internal temperature of a furnace, that is, a furnace, which is the main part of an ultra-high temperature steam generator equipped with a coil type superheater, according to an embodiment of the present disclosure.

Figure 19:
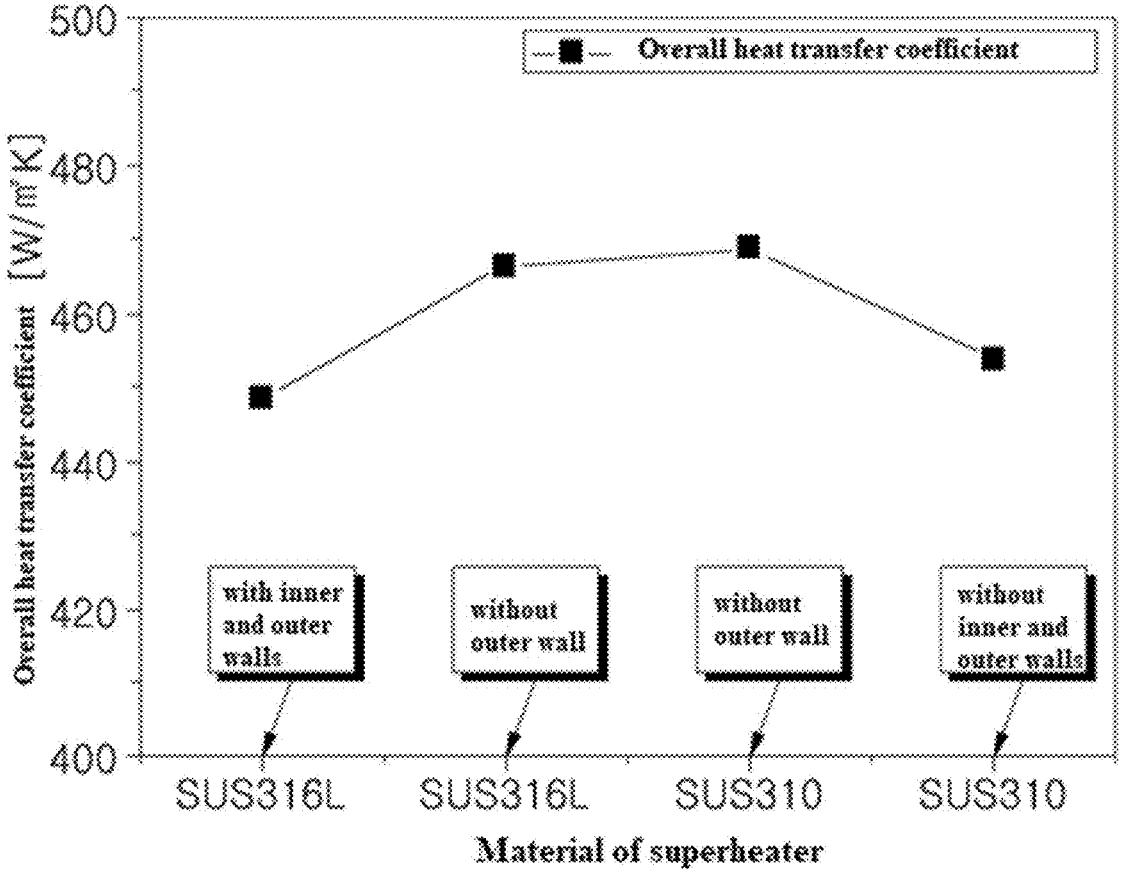
FIG. 19 shows a graph showing an overall heat transfer coefficient of each superheater, which is the main part of an ultra-high temperature steam generator equipped with a coil type superheater, according to various embodiments of the present disclosure.

In addition, FIG. 19 shows a graph showing an overall heat transfer coefficient of each superheater, which is the main part of an ultra-high temperature steam generator equipped with a coil type superheater, according to various embodiments of the present disclosure.

First, a system for performance test of a superheater may include a steam boiler, a furnace, and a superheater, which produce steam as shown in FIG. 5.

A pressure reducing valve keeps the primary steam pressure and steam flow supplied by an electric boiler to be constant.

Steam flowing through the pressure reducing valve enters an entry of the superheater in a state of superheated steam. It was configured such that ignition by a LNG gas burner occurs in the furnace, steam inside the superheater is heated by heat transfer with high temperature combustion gas, and ultra-high temperature steam is produced.

In the performance test of the superheater, a diameter of a steam line was 25 A, a material was SUS304, and it was insulated with glass fiber to prevent heat loss.

The superheater was installed inside the furnace.

The inside of the furnace was composed of a castable refractory of 150 mm to prevent heat loss, and the combustion exhaust gas was configured to be discharged through an upper pipe of the furnace.

In addition, a portion of the steam discharged from an exit of the superheater enters a heat exchanger in a water supply tank supplied to the electric boiler.

This serves to raise the temperature of water supplied to the boiler and to prevent the pressure of the boiler from dropping rapidly during the water supply.

Table 1 shows the specifications of the system. In order to measure the internal temperature distribution of the furnace, a total of 16 ceramic thermometers were installed, 4 per 4 directions, east, west, south, and north.

TABLE 1

| Steam boiler | Burner (LNG) | Steam flow meter | Pressure reducing valve | DAQ |
|---|---|---|---|---|
| Amount of steam generated: 40 [kg/h] | Calorific value: 186 [kW/h] | Allowable pressure: 14.7 [bar · abs] | Allowable pressure: 1~7 [bar · abs] | MX100, Labview |

Further, in order to measure the internal temperature distribution of the superheater, 12 thermometers were installed, 3 per 4 directions, east, west, south, and north.

The performance test results of the superheater are as follows.

First, an experiment was conducted on the production capability of ultra-high temperature steam.

In the experiment, an SUS316L superheater was used to observe the possibility of producing the ultra-high temperature steam.

Conditions for the entry of the superheater are about 140° C. and 3.4 bar, where the pressure is the absolute pressure.

The temperature condition for the entry is superheated steam at about 2-3° C. above the saturation temperature of 3.4 bar.abs.

In addition, the reason why the entry side of the superheater is low is that the utilization condition for hydrogen production is 3 bar.abs.

The temperatures and pressures of the entry and exit of the superheater are shown in FIGS. 6 and 7, respectively. It can be seen that the entry side of the superheater is kept constant under the experimental conditions.

The temperature at the exit side of the superheater was maintained at about 730° C. or higher, and the ultra-high temperature steam was obtained.

At this time, the internal temperature of the furnace is as shown in FIG. 8, and the ultra-high temperature steam was able to be produced when the combustion gas temperature is about 940° C.

Next, an experiment was conducted to compare a material and high temperature steam production capacity by structure of the superheater.

In the performance test for the superheater, the material of the superheater that may withstand an ultra-high temperature is very important. Further, it is important to use a large heat transfer area for the heat transfer with the combustion gas.

In the experiment, the experiment was conducted according to the material and type of the superheater.

The material of the superheater is two kinds, SUS316L and SUS310S. The type of the superheater used in the experiment may be classified into four types.

The types are as follows: a case where there is inner and outer walls of the SUS316L superheater; a case where there is no inner and outer walls of the SUS316L superheater; a case where there is no outer wall of the SUS310S superheater; and a case where there is only the temperature-raising pipe 323 (see FIGS. 11 to 14 B) without any inner and outer wall of the superheater.

This is for comparing the direct heating type with the indirect heating type, and the indirect heating type is a structure in which the inner wall and the outer wall are all installed as shown in FIGS. 14 A and 14 B.

In the experiment, four types of the superheaters were designed and fabricated to increase the heat transfer efficiency, and the experiment was conducted on this.

To obtain the heat transfer rate for each type when the same heat quantity was supplied, an overall heat transfer coefficient was calculated using Equation 1.

$$U = \frac{1}{1/h_s + t/k + 1/h_g} \quad \text{<Equation 1>}$$

$h_s$ is a heat transfer coefficient of steam in the superheater, and $h_g$ is a heat transfer coefficient of the combustion gas. Equation 2 was used.

$$h = \frac{Nuk}{D} \quad \text{<Equation 2>}$$

$$Nu = \frac{(f/8)(\mathrm{Re} - 1000)Pr}{1 + 12.7(f/8)^{0.5}(Pr^{0.667} - 1)} \quad \text{<Equation 3>}$$

$$\mathrm{Re} = \frac{\rho VD}{u} \quad \text{<Equation 4>}$$

$$f = (0.79\ln\mathrm{Re} - 1.64)^{-1} \quad \text{<Equation 5>}$$

For a Nusselt number, Gnielinski's Equation 3 used in forced convection was utilized. Equations 4 and 5 are used for a Reynolds number and a friction coefficient, respectively.

FIG. 19 compares the overall heat transfer coefficient according to each type, i.e., the embodiments.

For reference, in the case of the "inner wall" described in FIG. 19, it is set to assume and measure that there is an inner wall at a specific position inside the furnace 330 collectively without distinguishing between the first inner wall and the second inner wall.

Referring to FIG. 19, it may be seen that the heat transfer rate of the indirect heating type (a structure having only the inner wall in the superheater) is higher.

Among the indirect heating types except for the type in which the inner wall and the outer wall of the superheater are installed, the heat transfer rate in the case where there is only the inner wall of the superheater was about 4% higher than that of the direct heating type (the embodiments of FIGS. 11 and 12 in which the inner wall and the outer wall were omitted).

In addition, the results show that depending on whether or not there is the inner wall of the superheater, the heat transfer efficiency of the steam production apparatus may be improved and the heat resistance may be reduced.

Also, it is considered that the lower overall heat transfer coefficient when the inner and outer walls of the superheater are installed is due to the increase in flow rate of the combustion gas.

This is because the flow rate of the combustion gas flow rate is considerably increased due to a narrow gap between the inner wall and the outer wall of the superheater and it is discharged without being able to stay so long as the heat transfer with the superheater are sufficiently made.

In the present disclosure, it can be seen that the indirect heating type, which has the same shape as the inner wall of the superheart, has better heat transfer than the direct heating type. Through the experiments, basic data such as dimensionless numbers, friction coefficients, or the like were obtained.

This may be used as data for the derivation of equations for heat transfer correlations, in the future.

Hereinafter, the operation and effect of the ultra-high temperature steam generator equipped with the coil type superheater according to a preferred embodiment of the present disclosure will be described as follows.

First, the present disclosure includes an SRF boiler 310; a superheater 320 including an inlet port 321 connected to an exit side of the SRF boiler 310, into which steam discharged from the exit of the SRF boiler 310 is introduced, an outlet port 322 for discharge steam introduced through the inlet port 321, a temperature-raising pipe 323 for connecting the inlet port 321 and the outlet port 322 and forming a coil-shaped flow path for raising the temperature of the steam introduced through the inlet port 321; and a furnace 330 having a space into which the superheater 320 is built, the furnace including a gas inlet port 331 into which combustion gas is introduced, and a gas outlet port 332 through which the combustion gas is discharged, the combustion gas introducing from the gas inlet port 331 and transferring convection heat to the superheater 320. Therefore, steam production at an ultra-high temperature will be smoothly performed through heat transfer with high temperature combustion gas. Also, it will be able to obtain a large amount of high-quality steam for producing hydrogen to be used in a hydrogen production apparatus.

Further, the superheater 320 according to the present disclosure further includes a cylindrical first inner wall 324*a* having an outer circumferential surface of a first diameter D3 facing an inner circumferential surface of the temperature-raising pipe 323 forming the coil-shaped flow path. Therefore, it will be able to increase the residence time of the combustion gas and further improve the heat exchange efficiency through the convection heat by the combustion gas and the radiation heat by the external heat source.

Further, the superheater 320 according to the present disclosure further includes the cylindrical first inner wall 324*a* having the outer circumferential surface of the first diameter D3 facing the inner circumferential surface of the temperature-raising pipe 323 forming the coil-shaped flow path, or the cylindrical second inner wall 324*b* having an outer circumferential surface of the second diameter D4 smaller than the first diameter D3 facing the inner circumferential surface of the temperature-raising pipe 323. Therefore, it will be able to increase the residence time of the combustion gas and further improve the heat exchange efficiency through the convection heat by the combustion gas and the radiation heat by the external heat source. Moreover, it will be able to drastically improve the temperature raising effect of the steam discharged through the outlet port.

Further, the superheater 320 according to the present disclosure further includes the cylindrical first inner wall 324*a* having the outer circumferential surface of the first diameter D3 facing the inner circumferential surface of the temperature-raising pipe 323 forming the coil-shaped flow path, and the cylindrical outer wall 325 having the inner circumferential surface of the third diameter D5 larger than the first diameter D3 facing the outer circumferential surface of the temperature-raising pipe 323. Therefore, it will be able to supply the combustion gas to a space between the first inner wall 324*a* and the outer wall 325, thereby intensively supplying heat energy and increasing the heat exchange efficiency as the residence time of the combustion gas increases. Moreover, it will be able to minimize adverse effects due to the dust of the combustion gas.

Further, the superheater 320 according to the present disclosure further includes the cylindrical first inner wall 324*a* having the outer circumferential surface of the first diameter D3 facing the inner circumferential surface of the temperature-raising pipe 323 forming the coil-shaped flow path, or the cylindrical second inner wall 324*b* having the outer circumferential surface of the second diameter D4 smaller than the first diameter D3 facing the inner circumferential surface of the temperature-raising pipe 323, and the cylindrical outer wall 325 having the inner circumferential surface of the third diameter D5 larger than the first diameter D3 facing the outer circumferential surface of the temperature-raising pipe 323. Therefore, it will be able to supply the combustion gas to the space between the first inner wall 324*a* and the outer wall 325 or the space between the second inner wall 324*b* and the outer wall 325, thereby intensively supplying heat energy and increasing the heat exchange efficiency as the residence time of the combustion gas increases. Moreover, it will be able to minimize adverse effects due to the dust of the combustion gas.

Further, the superheater 320 according to the present disclosure further includes a downward straight pipe 326 connected to the inlet port 321, the downward straight pipe 326 causing the steam discharged from the exit of the SRF boiler 310 to descend and to be guided toward the temperature-raising pipe 323; and an upward straight pipe 327 connected to a lower end of the temperature-raising pipe 323 connected to the downward straight pipe 326, the upward straight pipe 327 causing the steam temperature-raised to ascend and to be guided toward the outlet port 322, in which the downward straight pipe 326 and the upward straight pipe 327 are orthogonal to an upper or lower surface of the furnace 330. Therefore, it will be able to further improve the heat exchange efficiency through the convection heat by the combustion gas and the radiation heat by the external heat source by allowing a flow of the steam supplied through the inlet port to be delayed to some extent through the temperature-raising pipe.

Figure 20:
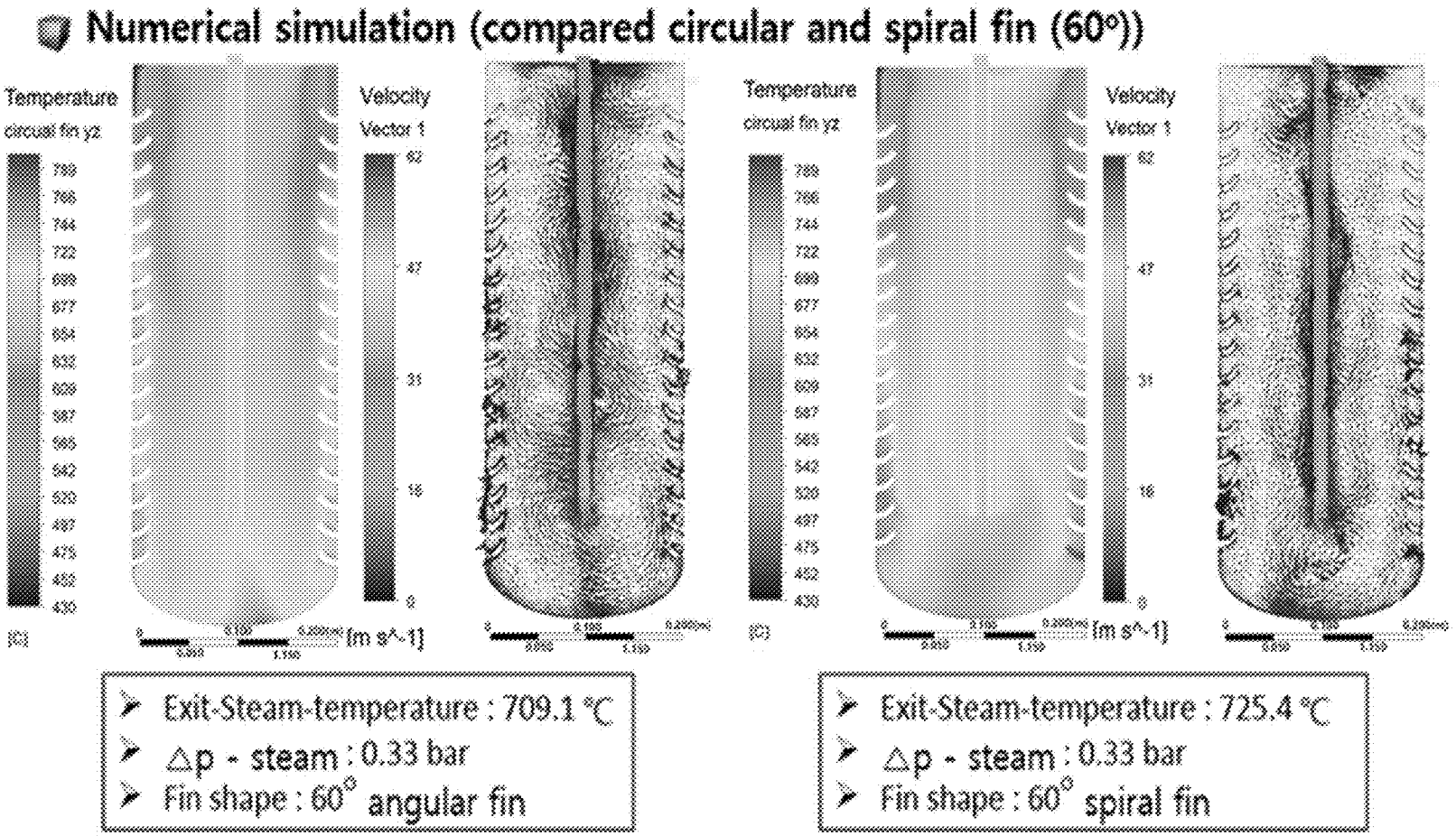
FIG. 20 shows a view showing the temperature raising effect of the embodiment shown in FIG. 1.

FIG. 20 shows a view showing the temperature raising effect of the embodiment shown in FIG. 1.

Referring to FIG. 20, on the left side, an angular fin is formed on the inner surface of the sidewall of the body 20, and on the right side, a spiral fin is formed on the inner surface of the sidewall of the body 20. Angles of the fins on both the left and right sides are 60 degrees. The left side is the numerical simulation result according to the prior arts, and the right side is the numerical simulation result according to the embodiment in FIG. 1. In the simulation result on the left side, an exit steam temperature is 709.1° C. In in the simulation results on the right side, an exit steam temperature is 725.4° C. As may be seen from the simulation results, the apparatus for raising the temperature of superheated steam according to the present disclosure, in which the spiral fin is formed on the inner surface of the sidewall of the body 20, has the superior temperature-raising effect as compared with the prior arts.

Figure 21:
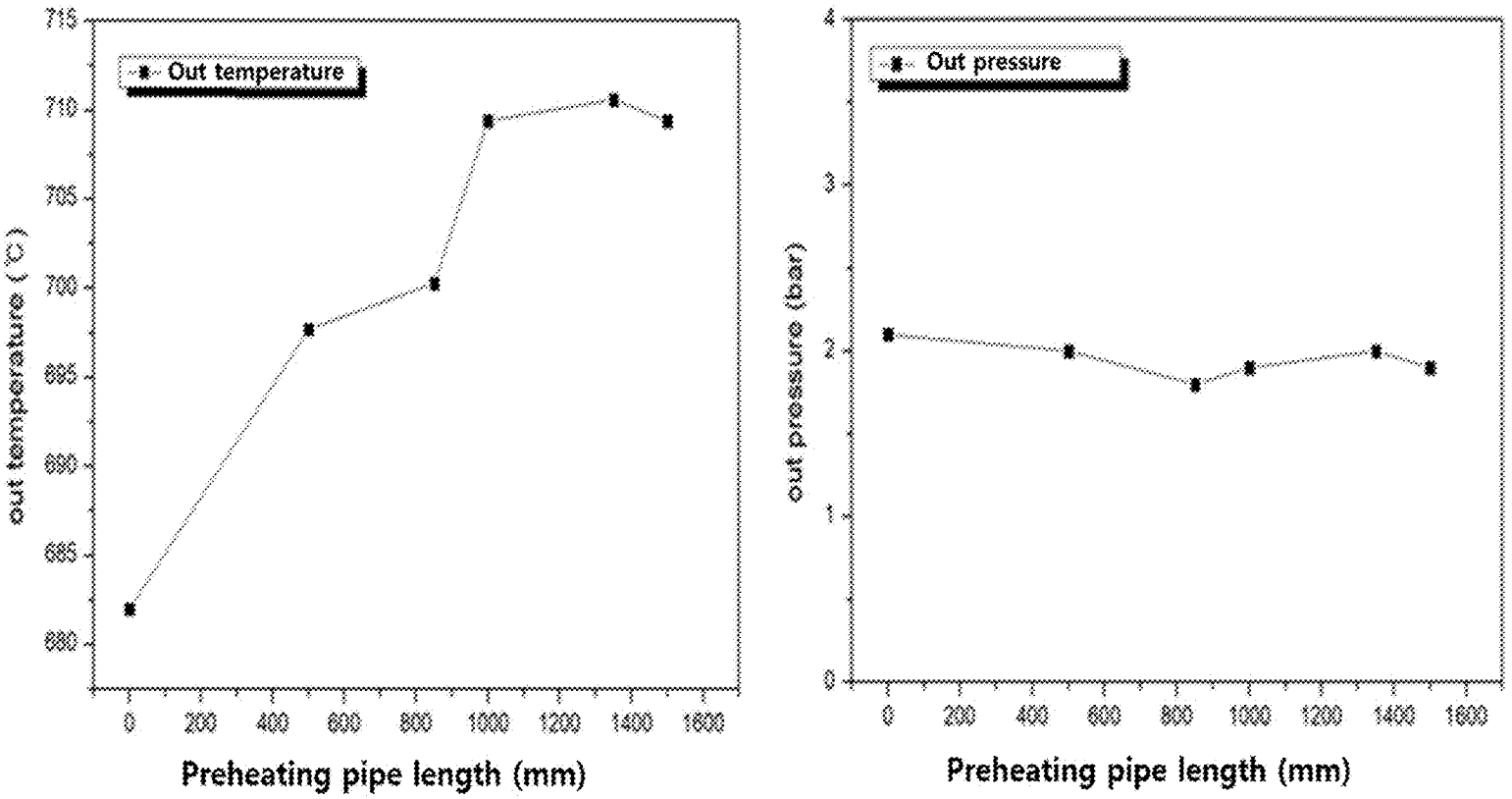
FIG. 21 shows a view showing the result of numerical analysis showing the temperature raising effect of the embodiment shown in FIG. 11.

FIG. 21 shows a view showing the result of numerical analysis showing the temperature raising effect of the embodiment shown in FIG. 11.

In the embodiment shown in FIG. 11, the temperature-raising pipe 323, which was not present in the prior arts, was introduced. The temperature-raising pipe 323 is formed between the inlet port 321 and the outlet port 322 and has a coil-shaped flow path structure so that the introduced steam may be temperature-raised while moving for as long as possible. Referring to the left side drawing in FIG. 21, it may be seen that an output temperature rises as a length of a preheatable pipe becomes longer. Therefore, it may be seen that the ultra-high temperature steam generator having the temperature-raising pipe 323 according to the present disclosure has the superior temperature-raising effect as compared with the conventional technology.

In addition, numerous other variations and applications are of course possible for those skilled in the art within the scope of the basic technical teaching of the present disclosure.

REFERENCE NUMERAL

10: inlet
20: body
30: outlet
50: apparatus for raising the temperature of superheated steam
110: first steam pipe
120: second steam pipe
121: upward pipe
122: downward pipe
123: connecting pipe
210: inner protrusion
220: outer protrusion
230: bottom protrusion
310: SRF boiler
320: superheater
321: inlet port
322: outlet port
323: temperature-raising pipe
324*a*: first inner wall
324*b*: second inner wall
325: outer wall
326: downward straight pipe
327: upward straight pipe
330: furnace
331: gas inlet port
332: gas outlet port
D3: first diameter
D4: second diameter
D5: third diameter

What is claimed is:

1. An apparatus for raising the temperature of superheated steam comprising:

an inlet into which superheated steam is introduced;

a body to raise the temperature of the superheated steam heated by an external heat source; and an outlet provided inside the body and discharging the superheated steam temperature-raised by the body to the outside, wherein an inner surface of a sidewall of the body is formed with an inner protrusion for heating the superheated steam while spirally rotating the superheated steam, wherein the inner protrusion protrudes from the inner surface of the sidewall of the body and has a spiral projection shape extending obliquely toward an inner surface of a bottom of the body, wherein a lower end of the outlet has an opening shape that is opened toward the inner surface of the bottom of the body in a state of being separated from the inner surface of the bottom of the body.

2. The apparatus of claim 1, wherein the superheated steam introduced through the inlet is induced as a first swirl while being spirally rotated by the inner protrusion, thereby primarily allowing a flow of the superheated steam to be enhanced, and at the same time, allowing heating efficiency to be increased by increasing a contact area with the inner protrusion heated by the external heat source.

3. The apparatus of claim 2, wherein the superheated steam guided to the inner surface of the bottom of the body by the inner protrusion is introduced into the lower end of the outlet having the opening shape that is opened toward the inner surface of the bottom of the body, and is discharged to the outside, thereby increasing heat discharge efficiency.

4. The apparatus of claim 1, wherein a protruding height of the inner protrusion is larger than a diameter of the inlet.

5. The apparatus of claim 1, wherein the outlet is connected to a hydrogen generator for electrolyzing water using an electrochemical cell, and the superheated steam temperature-raised is supplied to the hydrogen generator.

6. The apparatus of claim 1, wherein the body has a cylindrical structure whose cross-section perpendicular to a gravity direction is circular, and wherein the inner protrusion protrudes in a direction perpendicular to a tangent of the cylindrical structure.

7. The apparatus of claim 1, wherein a connecting portion between the inner protrusion and the inner wall of the sidewall has a contact surface with the superheated steam, with the contact surface having a concave shape.

8. The apparatus of claim 1, wherein a bottom protrusion is formed on the inner surface of the bottom of the body to rise the superheated steam so as to guide the superheated steam to the outlet.

9. The apparatus of claim 1, wherein the inner surface of the bottom of the body has a cone shape inverted with respect to the lower end of the outlet.

10. The apparatus of claim 9, wherein the superheated steam is concentrated in a vertex region of the inner surface of the bottom of the body having a cone shape, and then rises and is introduced into the outlet to discharge to the outside, thereby increasing heat discharge efficiency.

11. An apparatus for raising the temperature of superheated steam comprising:

an inlet into which superheated steam is introduced;

a body to raise the temperature of the superheated steam heated by an external heat source; and an outlet provided inside the body and discharging the superheated steam temperature-raised by the body to the outside, wherein an inner surface of a sidewall of the body is formed with an inner protrusion for heating the superheated steam while rotating the superheated steam along the inner surface of the sidewall, wherein an end of the inner protrusion has a shape bent upward in parallel with the inner surface of the sidewall of the body.

12. The apparatus of claim 11, wherein the superheated steam introduced through the inlet and induced as a first swirl by the inner protrusion is induced as a second swirl by the end of the inner protrusion, thereby secondarily allowing a flow of the superheated steam to be enhanced, and at the same time, allowing heating efficiency to be increased by increasing a contact area with the inner protrusion heated by the external heat source.

13. An apparatus for raising the temperature of superheated steam comprising:

an inlet into which superheated steam is introduced;

a body to raise the temperature of the superheated steam heated by an external heat source;

an outlet provided inside the body and discharging the superheated steam temperature-raised by the body to the outside; and a steam pipe forming a flow path through which the superheated steam flows and connected to the inlet, wherein the steam pipe is formed on an outer surface of the body, forms a flow path through which the superheated steam flows in a meandering shape along a horizontal direction with respect to an outer circumferential surface of the body, and surrounds the outer circumferential surface of the body.

14. The apparatus of claim 13, wherein the steam pipe comprises:

an upward pipe through which the superheated steam flows from a lower toward an upper with respect to the outer peripheral surface of the body;

a downward pipe through which the superheated steam flows from the upper toward the lower with respect to the outer peripheral surface of the body; and a connecting pipe to interconnect an upper end of the upward pipe and an upper end of the downward pipe or to interconnect a lower end of the upward pipe and a lower end of the downward pipe, wherein the steam pipe is formed by repeatedly disposing the upward pipe and the connecting pipe, and the downward pipe and the connecting pipe with respect to the outer peripheral surface of the body.

15. A temperature steam generator equipped with a coil type superheater comprising:

a superheater comprising an inlet port connected to an exit side of a boiler for introducing steam discharged from an exit of the boiler, an outlet port for discharge steam introduced through the inlet port, a temperature-raising pipe for interconnecting the inlet port and the outlet port and forming a coil-shaped flow path for raising the temperature of the steam introduced through the inlet port, a cylindrical first inner wall having an outer circumferential surface of a first diameter facing an inner circumferential surface of the temperature-raising pipe forming the coil-shaped flow path, or a cylindrical second inner wall having an outer circumferential surface of a second diameter smaller than the first diameter facing the inner circumferential surface of the temperature-raising pipe, and a cylindrical outer wall having an inner circumferential surface of a third diameter larger than the first diameter facing an outer circumferential surface of the temperature-raising pipe; and a furnace having a space into which the superheater is built, the furnace comprising a gas inlet port into which combustion gas is introduced, and a gas outlet port through which the combustion gas is discharged, the combustion gas introducing from the gas inlet port and transferring convection heat to the superheater.

16. The steam generator of claim 15, wherein the superheater further comprises:

a downward straight pipe connected to the inlet port, the downward straight pipe causing the steam discharged from the exit of the boiler to descend and to be guided toward the temperature-raising pipe; and an upward straight pipe connected to a lower end of the temperature-raising pipe connected to the downward straight pipe, the upward straight pipe causing the steam temperature-raised to ascend and to be guided toward the outlet port, wherein the downward straight pipe and the upward straight pipe are orthogonal to an upper or lower surface of the furnace.

* * * * *